US006305835B1

(12) United States Patent
Farrar et al.

(10) Patent No.: US 6,305,835 B1
(45) Date of Patent: Oct. 23, 2001

(54) APPARATUS FOR HANDLING AND PREPARING FLUIDS

(76) Inventors: Joseph Daniel Farrar, Villa Elamooyan, Tering Hill I kav. 85 Tering Bay, Resort, Nongsa, Batam (ID); Jimmy Phillip Lavoie, No. 1 Pandan Valley, #03-106, Camellia Terrace, 597625 (SG)

( * ) Notice: Subject to any disclaimer, the term of this patent is extended or adjusted under 35 U.S.C. 154(b) by 0 days.

(21) Appl. No.: 09/207,239

(22) Filed: Dec. 8, 1998

(51) Int. Cl.[7] ..... B01F 5/02

(52) U.S. Cl. ..... 366/162.4; 366/163.2; 366/173.2; 366/182.4; 366/336; 366/340; 366/341

(58) Field of Search ..... 366/336–341, 366/167.1, 173.2, 174.1, 182.1, 182.4, 163.2, 143, 181.5, 171.1, 162.4

(56) References Cited

U.S. PATENT DOCUMENTS

| | | |
|---|---|---|
| 1,730,453 | 10/1929 | Devon . |
| 1,885,559 | 11/1932 | Smith . |
| 2,922,441 | 1/1960 | Klute . |

(List continued on next page.)

OTHER PUBLICATIONS

Document "M" is related to the Lobestar Mixing Eductor.
Document "N" is related to the Vortex Ventures, Inc., Radial Eductor.
Document "O" is related to the Flo Trend® Systems, Inc., Jet Shear® II.
Document "P" is related to the Shear Terror by Double Life.
Document "Q" is related to the Flow Process Technologies [S] Pte,. Ltd., Jet Shear.
Document "R" is related to the Phoenix/Harrisburg/Woolley Solids Control System.
Document "S" is related to the ITS Drilling Services Super Shear/Homogenizer/Polygator.
Document "T" is related to the Geolograph Pioneer Sidewinder.
Document "U" is related to sale materials.
Document "V" is a printout from a patent related database.

*Primary Examiner*—W. L. Walker
*Assistant Examiner*—David Sorkin
(74) *Attorney, Agent, or Firm*—George S. Gray

(57) ABSTRACT

Apparatus and processes are provided for handling fluids in numerous industrial applications. Materials addition devices, including venturi hoppers, and other eductor assemblies, are joined in compact, horizontal, and/or vertical configurations, with one or more shearing devices, including, high and low velocity shearing devices individually, as well as, a combination high and low velocity shearing device. Pipe and valve configuration allow several alternate paths through or around such assemblies and devices, in alternate directions, including the option to backflow through the high velocity shearing device for the removal of obstructions. In the high velocity shearing devices provided, a special jet insert is provided, along with jet insert installation related apparatus, by which the jet insert is easily retained in, and removed from, the piping in the high velocity shearing device. Various inlets into the materials addition devices, either singularly, or in combination allow optional paths for the entry of bulk materials, as well as, powdered polymers, liquid chemicals, and other materials, with a special tangential inlet used in some cases to work in combination with other inlets, to prevent vacuum dead spots during the process of introducing materials through inlet paths other than the traditional hopper throat. Also provided is a detachable side plate adjacent the mixing chamber of the venturi hopper and/or eductor assemblies which, when removed, allows an additional port for the entry of bulk materials, and also allows quick inspection, servicing and/or removal of the venturi jet.

18 Claims, 17 Drawing Sheets

U.S. PATENT DOCUMENTS

| | | | |
|---|---|---|---|
| 3,833,718 | * | 9/1974 | Reed et al. . |
| 3,870,283 | | 3/1975 | Hurst . |
| 4,068,830 | | 1/1978 | Gray . |
| 4,518,568 | | 5/1985 | Shannon . |
| 4,664,528 | | 5/1987 | Rodgers et al. . |
| 4,753,535 | | 6/1988 | King . |
| 4,863,277 | * | 9/1989 | Neal et al. . |
| 5,322,222 | | 6/1994 | Lott . |
| 5,486,049 | | 1/1996 | Boatman et al. . |
| 5,560,710 | | 10/1996 | Klocke . |
| 5,765,946 | | 6/1998 | Lott . |

* cited by examiner

APPARATUS FOR HANDLING AND PREPARING FLUIDS

BACKGROUND OF THE INVENTION

The ability to mix various materials with fluids on a continuous high volume basis has been a goal in various industries for many years. The oil and gas drilling industry, for example, mixes large quantities of drilling fluid for downhole circulation during drilling. Such fluids are both water and oil based, and the materials added are varied, such as bentonite, barite, polymers, and many other liquids and powders. Other applications include a number of industries involving polymer mixing, water treatment, slurry walls, clay slurries, lime slurries, solubilizing dry chemicals, and horizontal drilling for industrial applications, such as river crossings.

Devices commonly utilized for such purposes, particularly in the oil and gas drilling industry, an eductor assembly generally, and a particular adaptation of an eductor assembly known as a venturi hopper, of the type having a base fluid inlet, a material funnel for feeding materials, a substantially vertical hopper throat, a hopper throat valve, and an eductor, having a mixing chamber, a jet, and a venturi discharge/diffuser which receives and discharges the jetted fluid, along with the materials drawn from the hopper throat into the jetted fluid by the venturi effect. Also utilized are low velocity shearing devices, which create turbulence in the fluid by moving the fluid through low shear plates and/or static mixers, as well as, high velocity shearing devices which typically involve dividing the fluid into two flows, then rejoining the flows in opposition to each other, the interaction causing beneficial impact and turbulence. The high velocity shearing devices typically involve jetting the fluid for additional turbulence.

The above devices have been combined into various systems, but such systems suffer from a lack of routing options among the devices, ineffective methods for adding special chemical powders, such as powdered polymers, ineffective secondary materials feed inlets in addition to the primary material funnel feed, a lack of routing for effective backflowing of the shearing devices, a failure to combine both the low and high velocity shearing devices, cumbersome service access to the jet, ineffective use of available space on location, and/or redundant power sources.

An example is U.S. Pat. No. 5,765,946 which provides a continuous static mixing apparatus and process which includes an eductor assembly, at least one "mixing disk," which create turbulence, and routing for the interaction of opposing flows. The processes which both the eductor and the mixing disks, include the base fluid entering either the eductor or the mixing disks first, then the other in series. No other routings are shown for the combined devices. The drawings do not depict alternate routings for an individual embodiment, nor is a routing suggested for backflowing through the mixing disks. More than one materials entry point into the eductor assembly is generally suggested, although the eductor assembly actually shown includes what appears to be a hopper throat only.

U.S. Pat. No. 5,322,222 discloses a spiral jet mixer for mixing fluids, which has a first inlet nozzle for the introduction of a primary fluid, a mixing chamber having a diverging wall and a converging wall, a plurality of angled helical passageways in the diverging wall for introduction of a secondary fluid into the mixing chamber in a spiraling turbulent, initially convergent flow pattern. The device is marketed by VORTEX VENTURES, INC., and is referred to as a radial eductor.

Another example is the LOBESTAR™ Mixing Eductor by VORTEX VENTURES, INC., includes a typical venturi hopper, modified to provide a "radial premixer," which has an inner liner within the throat, through which a substantial portion of the base fluid is routed, the base fluid being tangentially directed through the liner to create a vortex, the materials from the hopper being premixed, to some extent, with this portion of the base fluid, as the material is drawn into the eye of such vortex. The base fluid entry into the hopper throat is substantially lower than the hopper throat valve. Also included is a small "vacuum gauge and chemical injection inlet" which discharges into the mixing chamber. This device diverts an unacceptably large amount of the base fluid from the jet, requiring a lower amount of jetted fluid to draw a larger amount of"pre-mixed" base fluid and materials into the venturi discharge. The device also allows a vacuum to be created against a closed hopper valve, in cases where the "chemical injection inlet" is the sole source of materials. Such a vacuum is undesirable in that accumulations of materials can be created when partially wetted materials are drawn into the hopper throat area beneath the hopper throat valve. Similarly, the "chemical injection inlet" is too small to use for the introduction of powdered chemicals, and is impractical for use in applications in which this inlet is the sole source of materials being added to the base fluid. This impracticality is made worse by the reduction in vacuum caused by the routing of a substantial amount of fluid through the radial premixer. An additional problem is the ineffective access to the jet for replacement.

Another example is the SHEAR TEARER™ In-Line Shearing device, which provides a low velocity shearing device to be combined with a venturi hopper, in parallel only, with no high velocity shearing device, and no routing option for using the devices in series, no routing option system bypass, and no routing option for backflowing the fluid through the shearing device.

An additional example is the JET SHEART™ II, continuous mixing system by Flo Trend™ Systems, Inc., which includes a venturi hopper in series with two shearing devices, with a routing option to bypass the shearing devices, but not the venturi hopper. No routing option is provided for backflowing through the shearing device, and no low speed-shearing device is provided.

Similar to this device is the JET SHEAR™ manufactured by Flow Process Technologies [S] Pte. Ltd., in which the primary difference is the orientation of the fluid recombination path in the shearing device, changing from an angled recombination to an inline recombination of the fluid. The entering liquid is divided into two equal and opposing streams through a yoke assembly. These streams are directed into a mixing chamber through discs containing nozzles located in each end of the mixing chamber, which form the lateral boundaries of the mixing chamber. These nozzle plates are positioned to oppose each other. The nozzles contained in these respective plates are equally spaced on a circle located near the outer perimeter of the nozzle plates and are precisely angled with respect to the horizontal and vertical planes of the mixing chamber. The nozzles are identical in both plates, and since these plates are geometrically opposed, the liquid streams directed through each nozzle plate are moving in opposite rotational directions, one clockwise and one counterclockwise. Product literature suggests installing the device in parallel with the drilling rig mixing hopper.

U.S. Pat. No. 4,664,528 discloses an apparatus and method for mixing water in a water-soluble emulsion polymer, which includes a pump means, a static mixing means, and a mixing chamber means, where a first circulation means connects the pump means to the mixing chamber means, a second circulation means connects the pump means to the static mixing means, and further connects the static mixing means to the mixing chamber means. A third circulation means connects the static mixing means to the mixing chamber means. Flow control means selectively circulates the combined stream of the water and the polymer alternatively through the first circulation means, the second circulation means, or the third circulation means. The pump means has an inlet adapted to receive and combine the water and the emulsion polymer to form a combined stream of water and emulsion polymer. The apparatus has a static mixing means for mixing water and polymer, having an inlet adapted to receive and combine the water and the emulsion polymer to form the combined stream. The mixing chamber means produces a homoceneous mixture of the water and emulsion polymer.

A typical venturi hopper is the Phoenix Solids Control Systems device by Harrisburg/Woolley. In at least one device, Harrisburg/Woolley has utilized the mixing chamber suction by running a line from the mixing chamber to the top of the material funnel for the purpose of vacuuming "dust" generated during the addition of bulk materials, such as bentonite.

The SECO SUPER SHEAR™ by ITS Drilling Services is a variable speed-shearing device, which is installed either downstream or upstream of the rig-mixing hopper. It utilizes a SECO HOMOGENIZER, which is a field version of a colloid mill, and requires an electric motor. ITS Drilling Services also provides the POLYGATOR™ SHEARING SYSTEM, which also uses a SECO HOMOGENIZER.

The Geolograph-Pioneer SIDEWINDER™ uses two-stage cyclonic action which hydrates, mixes and blends mud additive particles to uniformity before discharge into the mud system. In this device the liquid is routed behind a liner in such a manner as to create a vortex into which dry bulk materials are fed prior to discharge of the liquid from the device.

U.S. Pat. No. 5,486,049 discloses a fluid and material mixing device involving a plurality of passages, with some embodiments including mixing means such as static mixers.

U.S. Pat. No. 1,730,453 discloses internal baffles along the length of an inlet manifold for an internal combustion engine.

U.S. Pat. No. 1,885,559 discloses a fuel mixing device for internal combustion engines, including a device having a plurality of mixing units within individual conduits from the carburetor to each cylinder.

U.S. Pat. No. 2,922,441 discloses a bypass or diversion fitting adapted to be inserted in the main line of a forced-feed circulatory heating system.

U.S. Pat. No. 3,870,283 discloses a method and apparatus for mixing a powder, such as lime, in flowable substance such as sewage sludge in which the flowable substance is introduced into a mixing chamber having an outlet, at a level below the outlet, in such a way that the flowable substance is induced to flow out of the outlet in a vortex flow, with the powder being introduced into the vortex flow.

U.S. Pat. No. 4,068,830 discloses a mixing method and system for the thorough intermixing of liquids of widely different viscosities using at least one perforated plate in the line of flow ahead of a conventional static mixer.

U.S. Pat. No. 4,518,568 discloses a system for preparing water-based drilling fluid having an enclosed mixing chamber with inlets for conveying supplies of water, heated fluid, and drilling fluid components into the interior of the mixing chamber, barrel means for retaining a supply of salt, piping means for conveying fluid from the interior of the mixing chamber to the interior of the barrel means and for conveying fluid from the interior of the barrel means to a suction pit, and additional piping means for conveying fluid from the suction pit to the interior of the mixing chamber and for conveying fluid from the interior of the mixing chamber directly to the suction pit.

U.S. Pat. No. 4,753,535 discloses a device for the mixing of two fluids in a conduit, the device being within the conduit substantially along the longitudinal axis of the conduit. A feed port introduces the second fluid into the device, which has miscellaneous mixing elements.

U.S. Pat. No. 5,560,710 discloses a process for continuously mixing streams of at least two fluid media, used particularly in reburning or progressive combustion and for secondary $NO_2$ reduction in flue gases from industrial furnace plants, where an auxiliary gas stream is injected into a main gas stream by means of swirl-momentum nozzles, which impart a characteristic axial impulse and an angular impulse to the fluid.

The above patents are incorporated herein by reference, for all purposes, as if set forth herein at length.

What is needed is a compact, unified system providing options for routing the fluid through the venturi hopper assembly and the shearing device in series, routing the fluid through each such device individually, routing the fluid to bypass any one or all of such devices, and routing the fluid in two directions through the shearing device, and which further provides a choice of high or low velocity shearing devices, including a combination high and low velocity shearing device, and which further provides a practical and effective process to introduce materials, bulk or otherwise, to the venturi hopper mixing chamber through an inlet other than, and to the exclusion of, the material funnels.

The apparatus and methods of our invention are manifested in numerous embodiments, which address, in whole or in part, the current need for a compact, unified system providing options for routing the fluid through the venturi hopper assembly and the shearing device in series, routing the fluid through each such device individually, routing the fluid to bypass any one or all of such devices, and routing the fluid in two directions through the shearing device, and which further provides a choice of high or low velocity shearing devices, including a combination high and low velocity shearing device, and which further provides a practical and effective process to introduce materials, bulk or otherwise, to the venturi hopper mixing chamber through an inlet other than, and to the exclusion of, the material funnels.

SUMMARY OF THE INVENTION

According to one embodiment, there is provided an apparatus for handling and preparing a fluid, comprising: a materials addition device, for receiving and adding one or more materials to the fluid; a shearing device for shearing fluid, the shearing device having a first and second end; a first pipe and valve combination comprising: an inlet for receiving the fluid into the apparatus; an outlet for discharging the fluid from the apparatus; inlet piping, having an inlet piping valve, the inlet piping connecting the inlet with the materials addition device; outlet piping, having an outlet piping valve, the outlet piping connecting the materials addition device with the outlet; a second pipe and valve combination comprising: shearing device first end piping, having a shearing device first end piping valve, the shearing device first end piping connecting the shearing device first end with the outlet piping; shearing device second end piping, having a first and a second shearing device second end piping valve, the shearing device second end piping connecting the shearing device second end with the outlet piping; and a third pipe and valve combination comprising: reverse flow piping, having a reverse flow piping valve, the reverse flow piping connecting the inlet piping to the shearing device second end piping.

According to a further embodiment the first pipe and valve combination outlet piping further comprises a second outlet piping valve, the second outlet piping valve being positioned between the first outlet piping valve and the materials addition device.

According to a further embodiment the second pipe and valve combination shearing device second end piping further comprises a shearing device second end piping third valve positioned between the shearing device second end piping second valve and the outlet.

According to one embodiment, there is provided an apparatus for handling and preparing a fluid, comprising: a materials addition device, for receiving and adding one or more materials to the fluid; a shearing device for shearing fluid; an inlet for receiving the fluid; an outlet for discharging the fluid; a first pipe and valve combination for routing the fluid from the inlet through the materials addition device, then through the discharge outlet; a second pipe and valve combination, cooperating with the first pipe and valve combination, for routing the fluid from the inlet through the materials addition device, through the fluid shearing device, then through the discharge outlet, such that the fluid moves through the shearing device in a first direction; and a third pipe and valve combination cooperating with the first and second pipe and valve combinations for routing the fluid from the inlet through the shearing device then through the discharge outlet, such that the fluid moves through the shearing device in a second direction.

According to a further embodiment, the materials addition device further comprises a first bulk material port for receiving one or more materials into the materials addition device.

According to a further embodiment, the materials addition device further comprises a vacuum inlet for receiving one or more materials into the materials addition device.

According to a further embodiment, the apparatus further comprises a vacuum inlet line, for routing materials to the vacuum inlet, and a vacuum inlet line valve.

According to a further embodiment, the vacuum inlet line valve is a ball valve.

According to a further embodiment, the vacuum inlet line valve is a regulating valve for adjusting the rate of material entry through the vacuum inlet.

According to a further embodiment, the apparatus further comprises a vacuum inlet line check valve positioned on the vacuum inlet line between the vacuum inlet and the vacuum inlet line valve, the vacuum inlet line check valve being attached to prevent flow from the materials addition device through the vacuum inlet line valve.

According to a further embodiment, the materials addition device further comprises a second bulk material port for receiving one or more bulk materials into the materials addition device.

According to a further embodiment, the materials addition device further comprises a detachable side portion, the second bulk material port being positioned on the side portion.

According to a further embodiment, the first bulk material port further comprises a material funnel for receiving one or more materials into the materials addition device.

According to a further embodiment, the materials addition device further comprises a venturi hopper.

According to a further embodiment, the materials addition device further comprises an eductor assembly.

According to a further embodiment, the first pipe and valve combination lies in a substantially planar orientation, and the materials addition device is rotatable positionally with respect to such plane, such that the materials addition device can be oriented to lie in the plane or at an angle thereto.

According to a further embodiment, the shearing device and the materials addition device are positioned in a substantially vertical plane.

According to a further embodiment, the materials addition device further comprises a detachable side portion.

According to a further embodiment, the fluid shearing device further comprises a plurality of conduits, each such conduit having a first end and a second end, the conduit first ends being positioned such that, as the fluid flows through the fluid shearing device, the fluid is diverted into the first ends of the plurality of conduits, and is discharged from the conduit second ends, the conduit second ends being positioned to discharge the fluid in opposing flows as the conduits are rejoined, such that all or some of the fluid in the opposing flows interacts.

According to a further embodiment, the apparatus further comprises a jet, the jet being positioned within at least one of the plurality of conduits such that the fluid in such at least one conduit is jetted as it is discharged from the second end of such at least one conduit.

According to a further embodiment, the apparatus further comprises a plurality of jets, each jet being positioned within one of the plurality of conduits such that the fluid in each conduit is jetted as it is discharged from the second end of each such conduit.

According to a further embodiment, the apparatus further comprises the plurality of jets, at least one of such jets further comprising a jet insert, the jet insert having a first end and a second end, the jet insert also having a plurality of bores extending from the jet insert first end toward the jet insert second end, each bore having an increasing cross-sectional area from the jet insert first end to the jet insert second end.

According to a further embodiment, the cross-sectional areas of the bores increase to such an extent that such cross-sectional areas overlap, resulting in the merger of the bores.

According to a further embodiment, the number of bores beginning at the jet insert first end is four.

According to a further embodiment, the apparatus further comprises the plurality of conduits, at least two such conduits having a conduit key attached within each such at least two conduits, and at least two of the jet inserts, each such jet insert having a key slot which corresponds to the conduit keys, such that when each of the at least two jet inserts are positioned within each of the at least two conduits, each of the plurality of bores on each of the at least two jet inserts, aligns with one of the plurality of bores on another of the at least two jet inserts.

According to a further embodiment, the apparatus further comprises the plurality of conduits, at least one of such conduits having a jet insert seat for seating and positioning the jet insert within the conduit, the jet insert seat comprising a ring attached within the conduit such that the jet insert second end is adjacent the ring.

According to a further embodiment, the apparatus further comprises the jet insert seat ring, the ring having an internal diameter, which is tapered toward the conduit second end.

According to a further embodiment, the apparatus further comprises the jet insert seat ring, the ring having an internal diameter, which is partially tapered toward the conduit second end.

According to a further embodiment, the apparatus further comprises the plurality of conduits, at least one of such conduits having a circumferential groove within such conduit, the groove being proximate the jet insert first end, and at least one snap ring, the snap ring being sized to be closely received by such conduit groove, such that the jet insert is secured within the conduit.

According to a further embodiment, the apparatus further comprises an O-ring positioned between each jet insert and conduit, sealing each such jet insert, such that fluid flow in each such conduit is routed through each such jet insert.

According to a further embodiment, the conduits rejoin at an angle such that the discharged fluid flows are substantially in-line.

According to a further embodiment, the conduits rejoin at an angle such that the discharged fluid flows are only partially opposing.

According to a further embodiment, the apparatus further comprises the plurality of conduits, at least one such conduit having a closable removal tool port, the removal tool port being positioned such that a removal tool can be inserted into such conduit.

According to a further embodiment, the removal tool port is positioned with respect to the at least one conduit such that a substantially straight tool enters such conduit along a path which is substantially parallel to the longitudinal axis of such conduit.

According to a further embodiment, the shearing device comprises at least one shear plate, the at least one shear plate being positioned within the shearing device such that the fluid passes through the at least one shear plate as the fluid moves through the shearing device.

According to a further embodiment, the shearing device comprises at least one static mixer, the at least one static mixer being positioned within the shearing device such that the fluid passes through the at least one static mixer as the fluid moves through the gearing device.

According to a further embodiment, the shearing device comprises at least one shear plate and at least one static mixer, the at least one static mixer being positioned within the shearing device such that the fluid passes through the at least one shear plate and the at least one static mixer as the fluid moves through the shearing device.

According to one embodiment there is provided an apparatus for handling and preparing a fluid, comprising: a materials addition device, for receiving and adding one or more materials to the fluid; a shearing device for shearing fluid, the shearing device having a first and second end; a first pipe and valve combination comprising: inlet means for receiving the fluid into the apparatus; outlet means for discharging the fluid from the apparatus; inlet piping means, having an inlet piping valve, the inlet piping means connecting the inlet with the materials addition device; outlet piping means, having an outlet piping valve, the outlet piping means connecting the outlet means to the materials addition device; a second pipe and valve combination comprising: shearing device first end piping means, having a shearing device first end piping valve, the shearing device first end piping means connecting the shearing device first end piping means to the outlet piping means; shearing device second end piping means, having a first and a second shearing device second end piping valve, the shearing device second end piping means connecting the shearing device second end with the outlet piping means; and a third pipe and valve combination comprising: reverse flow piping means, having a reverse flow piping valve, the reverse flow piping means connecting the inlet piping means with the shearing device second end piping means.

According to a further embodiment the first pipe and valve combination outlet piping means further comprises a second outlet piping valve, the second outlet piping valve being positioned between the first outlet piping valve and the materials addition device.

According to a further embodiment the second pipe and valve combination shearing device second end piping means further comprises a shearing device second end piping third valve positioned between the shearing device second end piping second valve and the outlet means.

According to a further embodiment the shearing device further comprises means for dividing the fluid into a plurality of flows proximate the shearing device first end, and rejoining the plurality of fluid flows to a single fluid flow proximate the shearing device second end.

According to a further embodiment, the shearing device further comprises at least one shearing means for shearing the fluid as the fluid enters the shearing device through the shearing device first end and exits the shearing device through the shearing device second end.

According to a further embodiment, the shearing device further comprises at least one shearing means for shearing the fluid as the fluid enters the shearing device through the shearing device second end and exits the shearing device through the shearing device first end.

According to a further embodiment, the shearing device further comprises at least two shearing means for shearing the fluid as the fluid enters the shearing device through the shearing device second end and exits the shearing device through the shearing device first end.

According to one embodiment, there is provided an apparatus for handling and preparing a fluid, comprising: means for receiving the fluid through an inlet; means for routing the fluid from the inlet through a materials addition device, then a discharge outlet; means for routing the fluid from the inlet through the materials addition device, through a shearing device, then through the discharge outlet, such that the fluid moves through the shearing device in a first direction; means for routing the fluid from the inlet through the shearing device then through the discharge outlet, such that the fluid moves through the shearing device in a second direction; and means for routing the fluid from the inlet through the discharge outlet.

According to a further embodiment, the apparatus further comprises means for receiving one or more materials into the fluid as the fluid moves through the materials addition device.

According to a further embodiment, the means for receiving one or more materials further comprises means for receiving the one or more materials through a first bulk material port, the bulk material port being positioned on the materials addition device such that received materials enter the materials addition device.

According to a further embodiment, the means for receiving one or more materials further comprises means for receiving the one or more materials through a vacuum inlet, the vacuum inlet being positioned on the materials addition device such that received materials enter the materials addition device.

According to a further embodiment, the means for receiving the one or more materials through a vacuum inlet further comprises means for routing materials to the vacuum inlet.

According to a further embodiment, the means for receiving one or more materials further comprises means for receiving the one or more materials through either of two bulk material ports, each of the two bulk material ports being positioned on the materials addition device such that received materials enter the materials addition device.

According to a further embodiment, the means for receiving one or more materials further comprises means for receiving the one or more materials through a material funnel, the material funnel being positioned on the materials addition device in a substantially vertical position.

According to a further embodiment, the apparatus further comprises means for rotating the materials addition device prior to routing the fluid through the materials addition device.

According to a further embodiment, the apparatus further comprises means for positioning the shearing device and the materials addition device in a substantially vertical plane.

According to a further embodiment, the means for routing the fluid through the shearing device in a second direction further comprises means for dividing the fluid into a plurality of flows, then rejoining such plurality of flows into a single flow.

According to a further embodiment, the means for dividing and rejoining the fluid flow further comprises means for rejoining the flows such that the fluid from each of such flows interacts with the fluid from at least one other of such flows as such flows rejoin.

According to a further embodiment, the means for dividing and rejoining the fluid flow further comprises means for jetting the fluid in at least one of such fluid flows.

According to a further embodiment, the means for dividing and rejoining the fluid flow, further comprises means for jetting the fluid within each of flows such that the jetted fluid interacts with the jetted fluid from at least one other of such flows as the fluid is being rejoined.

According to a further embodiment, the means for jetting the fluid within each of such fluid flows further comprises: means for diverting the fluid within each such flow into a plurality of sub-flows; and means for tapering each of such sub-flow's cross-sectional area to the point of jetting.

According to a further embodiment, the number of sub-flows in each such flow is four.

According to a further embodiment the means for diverting the fluid within each such flow into a plurality of sub-flows, further comprises means for aligning each jetted sub-flow in the plurality of sub-flows in one of the plurality of flows, with one of the jetted sub-flows in the plurality of sub-flows in another of the plurality of flows.

According to a further embodiment, the means for routing the fluid through the shearing device in a second direction further comprises means for routing the fluid through at least one shear plate.

According to a further embodiment, the means for routing the fluid through the shearing device in a second direction further comprises means for routing the fluid through at least one static mixer.

According to a further embodiment, the means for routing the fluid through the shearing device in a second direction further comprises means for routing the fluid through at least one static mixer and at least one shear plate.

According to a further embodiment, the means for routing the fluid through a shearing device in a first direction further comprises means for routing the fluid through at least one shear plate.

According to a further embodiment, the means for routing the fluid through a shearing device in a first direction further comprises means for routing the fluid through at least one static mixer.

According to a further embodiment, the means for routing the fluid through a shearing device in a first direction further comprises means for routing the fluid through at least one static mixer and at least one shear plate.

According to a further embodiment, the means for routing the fluid through a shearing device in a first direction further comprises means for dividing the fluid into a plurality of flows, and rejoining the plurality of fluid flows to a single fluid flow.

According to a further embodiment, the means for routing the fluid through the shearing device in a first direction further comprises means for shearing the fluid using at least one low velocity shearing means.

According to a further embodiment, the means for routing the fluid through the shearing device in a second direction further comprises means for shearing the fluid using at least one low velocity shearing means.

According to a further embodiment, the means for routing the fluid through the shearing device in a second direction further comprises the means for shearing the fluid using at least one high velocity shearing means.

According to a further embodiment, the apparatus further comprises means for inserting a tool into the shearing device, the direction of the tool insertion being along the longitudinal axis of the shearing device.

According to one embodiment, there is a process for handling and preparing a fluid, comprising the steps of: (a) receiving the fluid through an inlet; (b) routing the fluid through a materials addition device or bypassing the materials addition device; (c) routing the fluid from the materials addition device through a shearing device in a first direction, or routing the fluid through a discharge outlet; (d) routing the bypassed fluid of step (b) through the shearing device in a second direction, or routing the fluid through the discharge outlet; and (e) routing the fluid from the shearing device through the discharge outlet.

According to a further embodiment, the process further comprises the step of receiving one or more materials into the fluid as the fluid moves through the materials addition device.

According to a further embodiment, the step of receiving one or more materials further comprises the step of receiving the one or more materials through a first bulk material port, the bulk material port being positioned on the materials addition device such that received materials enter the materials addition device.

According to a further embodiment, the step of receiving one or more materials further comprises the step of receiving the one or more materials through either of two bulk material ports, each of the two bulk material ports being positioned on the materials addition device such that received materials enter the materials addition device.

According to a further embodiment, the step of receiving one or more materials further comprises the step of receiving the one or more materials through a vacuum inlet, the vacuum inlet being positioned on the materials addition device such that received materials enter the materials addition device.

According to a further embodiment, the step of receiving the one or more materials through a vacuum inlet further comprises the step of routing materials to the vacuum inlet.

According to a further embodiment, the step of receiving one or more materials further comprises the step of receiving the one or more materials through a material funnel, the material funnel being positioned on the materials addition device in a substantially vertical position.

According to a further embodiment, the process further comprises the step of rotating the materials addition device prior to routing the fluid through the materials addition device.

According to a further embodiment, the process further comprises the step of positioning the shearing device and the materials addition device in a substantially vertical plane.

According to a further embodiment, the routing the fluid through the shearing device in a second direction step further comprises the step of routing the fluid through a plurality of conduits, the plurality of conduits then rejoining to a single conduit.

According to a further embodiment, the routing the fluid through a plurality of conduits step further comprises the step of discharging the fluid from the plurality of conduits such that the fluid from each of such conduits interacts with the fluid from at least one other of such conduits as such conduits rejoin.

According to a further embodiment, the routing the fluid through a plurality of conduits step further comprises the step of jetting the fluid within at least one such conduit.

According to a further embodiment, the discharging the fluid from a plurality of conduits step further comprises the step of jetting the fluid within each of such conduits such that the jetted fluid interacts with the jetted fluid from at least one other of such conduits as the fluid is being discharged.

According to a further embodiment, the step of jetting the fluid within each of such conduits further comprises the steps of: diverting the fluid within each such conduit into a plurality of flows; and tapering each such flow's cross-sectional area to the point of jetting.

According to a further embodiment, the number of flows in each conduit is four.

According to a further embodiment, the step of diverting the fluid within each such conduit into a plurality of flows, further comprises the step of aligning each jetted flow in the plurality of flows in one of the plurality of conduits, with one of the jetted flows in the plurality of flows in another of the plurality of conduits.

According to a further embodiment, the routing the fluid through the shearing device in a second direction step further comprises the step of routing the fluid through at least one shear plate.

According to a further embodiment, the routing the fluid through the shearing device in a second direction step further comprises the step of routing the fluid through at least one static mixer.

According to a further embodiment, the routing the fluid through the shearing device in a second direction step further comprises the step of routing the fluid through at least one static mixer and at least one shear plate.

According to a further embodiment, the routing the fluid through a shearing device in a first direction step further comprises the step of routing the fluid through at least one shear plate.

According to a further embodiment, the routing the fluid through a shearing device in a first direction step further comprises the step of routing the fluid through at least one static mixer.

According to a further embodiment, the routing the fluid through a shearing device in a first direction step further comprises the step of routing the fluid through at least one static mixer and at least one shear plate.

According to a further embodiment, the routing the fluid through a shearing device in a first direction step further comprises the step of routing the fluid through a plurality of conduits, the plurality of conduits then rejoining to a single conduit.

According to a further embodiment, the routing the fluid through the shearing device in a first direction step further comprises the step of shearing the fluid using at least one low velocity shearing means.

According to a further embodiment, the routing the fluid through the shearing device in a second direction step further comprises the step of shearing the fluid using at least one low velocity shearing means.

According to a further embodiment, the routing the fluid through the shearing device in a second direction step further comprises the step of shearing the fluid using at least one high velocity shearing means.

According to one embodiment, there is provided an apparatus for shearing a fluid, comprising the steps of: an inlet for receiving the fluid; a first shearing device, in fluid communication with the inlet; a second shearing device, in fluid communication with the inlet, the second shearing device having a higher resistance to the flow of the fluid than the first shearing device; a valve positioned with respect to the first shearing device such that the fluid is alternately directed through the first shearing device or the second shearing device; and an outlet, the outlet being positioned to receive all fluid from the first and second shearing devices.

According to a further embodiment, the first shearing means comprises at least one low shear plate, the at least one shear plate being positioned within the first shearing device such that the fluid passes through the at least one shear plate as the fluid moves through the first shearing device.

According to a further embodiment, the first shearing device comprises at least one static mixer, the at least one static mixer plate being positioned within the first shearing device such that the fluid passes through the at least one static mixer as the fluid moves through the first shearing device.

According to a further embodiment, the first shearing device comprises at least one shear plate and at least one static mixer, the at least one static mixer plate being positioned within the shearing device such that the fluid passes through the at least one shear plate and the at least one static mixer as the fluid moves through the first shearing device.

According to a further embodiment, the first shearing device further comprises at least one low velocity shearing means such that the fluid passes through the at least one low velocity shearing means as the fluid moves through the first shearing device.

According to a further embodiment, the second shearing device further comprises at least one high velocity shearing means such that the fluid passes through the at least one high velocity shearing means as the fluid moves through the second shearing device.

According to a further embodiment, the second shearing device further comprises a plurality of conduits, each such conduit having a first end and a second end, the conduit first ends being positioned such that, as the fluid flows through the second shearing device, the fluid is diverted into the first ends of the plurality of conduits, and is discharged from the conduit second ends, the conduit second ends being positioned to discharge the fluid in opposing flows as the fluid flows are rejoined, such that all or some of the fluid in the opposing flows interacts.

According to a further embodiment, the apparatus further comprises a jet, the jet being positioned within at least one of the plurality of conduits such that the fluid in such at least one conduit is jetted as it is discharged from the second end of such at least one conduit.

According to a further embodiment, the apparatus further comprises a plurality of jets, each jet being positioned within one of the plurality of conduits such that the fluid in each conduit is jetted as it is discharged from the second end of each such conduit.

According to a further embodiment, the apparatus further comprises the plurality of jets, at least one of such jets further comprising a jet insert, the jet insert having a first end and a second end, the jet insert also having a plurality of bores extending from the jet insert first end toward the jet insert second end, each bore having an increasing cross-sectional area from the jet insert first end to the jet insert second end.

According to a further embodiment, the cross-sectional areas of the bores increase to such an extent that such cross-sectional areas overlap, resulting in the merger of the bores.

According to a further embodiment, the number of bores beginning at the jet insert first end is four.

According to a further embodiment, the apparatus further comprises the plurality of conduits, at least two such conduits having a conduit key attached within each such at least two conduits, and at least two of the jet inserts, each such jet insert having a key slot which corresponds to the conduit keys, such that when each of the at least two jet inserts are positioned within each of the at least two conduits, each of the plurality of bores on each of the at least two jet inserts, aligns with one of the plurality of bores on another of the at least two jet inserts.

According to a further embodiment, the apparatus further comprises the plurality of conduits, at least one of such conduits having a jet insert seat for seating and positioning the jet insert within the conduit, the jet insert seat comprising a ring attached within the conduit such that the jet insert second end is adjacent the ring.

According to a further embodiment, the apparatus further comprises the jet insert seat ring, the ring having an internal diameter, which is tapered toward the conduit second end.

According to a further embodiment, the apparatus further comprises the jet insert seat ring, the ring having an internal diameter, which is partially tapered toward the conduit second end.

According to a further embodiment, the apparatus further comprises the plurality of conduits, at least one of such conduits having a circumferential groove within such conduit, the groove being proximate the jet insert first end, and at least one snap ring, the snap ring being sized to be closely received by such conduit groove, such that the jet insert is secured within the conduit.

According to a further embodiment, the apparatus further comprises an O-ring positioned between each jet insert and conduit, sealing each such jet insert, such that fluid flow in each such conduit is routed through each such jet insert.

According to a further embodiment, the conduits rejoin at an angle such that the discharged fluid flows are substantially in-line.

According to a further embodiment, the conduits rejoin at an angle such that the discharged fluid flows are only partially opposing.

According to a further embodiment, the apparatus further comprises the plurality of conduits, at least one such conduit having a closable removal tool port, the removal tool port being positioned such that a removal tool can be inserted into such conduit.

According to a further embodiment, the removal tool port is positioned with respect to the at least one conduit such that a substantially straight tool enters such conduit along a path which is substantially parallel to the longitudinal axis of such conduit.

According to one embodiment, there is provided an apparatus for shearing a fluid, comprising: means for receiving the fluid through a fluid inlet; means for routing the fluid through a shearing device via a first path; means for routing the fluid through a shearing device via a second path; and means for routing the sheared fluid through a discharge outlet.

According to a further embodiment, the means for routing the fluid through a shearing device via a first path further comprises means for routing the fluid through at least one shear plate.

According to a further embodiment, the means for routing the fluid through a shearing device via a first path further comprises means for routing the fluid through at least one static mixer.

According to a further embodiment, the means for routing the fluid through a shearing device via a first path further comprises means for routing the fluid through at least one static mixer and at least one shear plate.

According to a further embodiment, the means for routing the fluid through the shearing device via a second path further comprises means for dividing the fluid into a plurality of flows, then rejoining such plurality of flows into a single flow.

According to a further embodiment, the means for dividing and rejoining the fluid flow further comprises means for jetting the fluid in at least one of such fluid flows.

According to a further embodiment, the means for dividing and rejoining the fluid flow further comprises means for rejoining the flows such that the fluid from each of such flows interacts with the fluid from at least one other of such flows as such flows rejoin.

According to a further embodiment, the means for dividing and rejoining the fluid flow, further comprises means for jetting the fluid within each of such fluid flows such that the jetted fluid interacts with the jetted fluid from at least one other of such fluid flows as the fluid is being rejoined.

According to a further embodiment, the means for jetting the fluid within each of such fluid flows further comprises: means for diverting the fluid within each such flow into a plurality of sub-flows; and means for tapering each of such sub-flow's cross-sectional area to the point of jetting.

According to a further embodiment, the number of sub-flows in each such flow is four.

According to a further embodiment, the means for diverting the fluid within each such flow into a plurality of sub-flows, further comprises means for aligning each jetted sub-flow in the plurality of sub-flows in one of the plurality of flows, with one of the jetted sub-flows in the plurality of sub-flows in another of the plurality of flows.

According to a further embodiment, the apparatus further comprises means for inserting a tool into the shearing device, the direction of the tool insertion being along the longitudinal axis of the shearing device second path.

According to one embodiment, there is a process for shearing a fluid, comprising the steps of: (a) receiving the fluid through a fluid inlet; (b) routing the fluid through a shearing device via a first path, (c) as an alternative to step (b), routing the fluid through the shearing device via a second path; and (d) routing the sheared fluid through a discharge outlet.

According to a further embodiment, the routing the fluid through a shearing device via a first path step further comprises the step of routing the fluid through at least one shear plate.

According to a further embodiment, the routing the fluid through a shearing device via a first path step further comprises the step of routing the fluid through at least one static mixer.

According to a further embodiment, the routing the fluid through a shearing device via a first path step further comprises the step of routing the fluid through at least one static mixer and at least one shear plate.

According to a further embodiment, the routing the fluid through the shearing device via a second path step further comprises the step of routing the fluid through a plurality of conduits, the plurality of conduits then rejoining to a single conduit.

According to a further embodiment, the routing the fluid through a plurality of conduits step further comprises the step of jetting the fluid within at least one of such conduits.

According to a further embodiment, the routing the fluid through a plurality of conduits step further comprises the step of discharging the fluid from the plurality of conduits such that the fluid from each of such conduits interacts with the fluid from at least one other of such conduits as such conduits rejoin.

According to a further embodiment, the discharging the fluid from a plurality of conduits step further comprises the step of jetting the fluid within each of such conduits such that the jetted fluid interacts with the jetted fluid from at least one other of such conduits as the fluid is being discharged.

According to a further embodiment, the step of jetting the fluid within each of such conduits further comprises the steps of: diverting the fluid within each such conduit into a plurality of flows; and tapering each such flow's cross-sectional area to the point of jetting.

According to a further embodiment, the number of flows in each conduit is four.

According to a further embodiment, the step of diverting the fluid within each such conduit into a plurality of flows, further comprises the step of aligning each jetted flow in the plurality of flows in one of the plurality of conduits, with one of the jetted flows in the plurality of flows in another of the plurality of conduits.

According to one embodiment, there is provided an apparatus for jetting a fluid, comprising a jet, the jet having a first end and a second end, the jet also having a plurality of bores extending from the jet first end toward the jet second end, each bore having an increasing cross-sectional area from the jet first end to the jet second end.

According to a further embodiment, the cross-sectional areas of the bores increase to such an extent that such cross-sectional areas overlap, resulting in the merger of the bores.

According to a further embodiment, the number of bores beginning at the jet first end is four.

According to one embodiment, there is provided an apparatus for jetting a fluid, comprising: means for receiving the fluid into a first section of a device, the first section having a bore for receiving fluid, the bore having a decreasing cross-sectional area in the direction of fluid flow; means for receiving the fluid into a second section of a device, the section diverting the fluid into four fluid flows in four bores, the four bores having a decreasing cross-sectional area in the direction of flow; and means for discharging the fluid from the four bores.

According to a further embodiment, the apparatus further comprises means for receiving the fluid in and through a ring prior to receiving the fluid into the first section.

According to a further embodiment, the ring has a decreasing internal diameter in the direction of the fluid flow.

According to a further embodiment, the apparatus further comprises means for positioning the device within a conduit, such that fluid is received from the conduit.

According to one embodiment, there is a process for jetting a fluid, comprising the steps of: (a) receiving the fluid into a first section of a device, the first section having a bore for receiving fluid, the bore having a decreasing cross-sectional area in the direction of fluid flow; (b) receiving the fluid into a second section of a device, the section diverting the fluid into four fluid flows in four bores, the four bores having a decreasing cross-sectional area in the direction of flow; and (c) discharging the fluid from the four bores.

According to a further embodiment, the process further comprises the step of receiving the fluid in and through a ring prior to step (a).

According to a further embodiment, the ring has a decreasing internal diameter in the direction of the fluid flow.

According to a further embodiment, the process further comprises the step of positioning the device within a conduit, such that fluid is received from the conduit.

According to one embodiment, there is provided an apparatus for positioning one or more jets in a fluid shearing device, comprising: a fluid shearing device conduit, the conduit having an end, the conduit end shaped for receiving the jet, the conduit further having a circumferential groove; a seat ring, the seat ring being attached within the fluid shearing device conduit such that the jet is positioned proximate the conduit end; a snap ring, the snap ring being sized to be closely received and positioned by the conduit groove, such that the snap ring retains the jet within the conduit.

According to a further embodiment, the apparatus further comprises the seat ring, the seat ring having an internal diameter, which is tapered toward the conduit end.

According to a further embodiment, the apparatus further comprises the seat ring, the seat ring having an internal diameter, which is partially tapered toward the conduit end.

According to a further embodiment, the apparatus further comprises an O-ring positioned between the jet and the conduit for sealing the jet within the conduit such that fluid flow from the conduit is routed through the jet.

According to a further embodiment, the apparatus further comprises the conduit, the conduit having a conduit key attached within the conduit, the conduit key corresponding with a key slot on the jet, for rotationally positioning the jet.

According to a further embodiment, the number of the conduits is two and the number of the jets is two.

According to a further embodiment, the conduits are positioned such that the fluid flows discharged by the two jets interact.

According to a further embodiment, each jet has a key slot, further comprising the two conduits, the conduits each having a conduit key attached within each such conduit, each such conduit key corresponding with the key slot on each of the jets, for rotationally positioning the jets, such that the jetted fluid flows are aligned.

According to one embodiment, there is provided an apparatus for positioning one or more jets in a fluid shearing device, comprising: means for receiving at least one jet into at least one fluid shearing device conduit; means for retaining the at least one jet proximate the end of the at least one conduit, such that fluid jetted by the jet is discharged from the end of the at least one conduit; means for retaining the at least one jet within the at least one conduit; and means for sealing the at least one jet within the at least one conduit such that all fluid from the at least one conduit is routed through the at least one jet.

According to a further embodiment, the apparatus further comprises means for rotationally positioning the at least one jet within the at least one conduit.

According to a further embodiment, the number of the conduits is two and the number of the jets is two.

According to a further embodiment, the apparatus further comprises means for positioning the fluid flows discharged by the two jets such that the fluid flows interact.

According to a further embodiment, the apparatus further comprises means for rotationally aligning the two jets such that the fluid flows from both jets are aligned.

According to one embodiment, there is a process for positioning one or more jets in a fluid shearing device, comprising the steps of: receiving at least one jet into at least one fluid shearing device conduit; retaining the at least one jet proximate the end of the at least one conduit, such that fluid jetted by the jet is discharged from the end of the at least one conduit; retaining the at least one jet within the at least one conduit; and sealing the at least one jet within the at least one conduit such that all fluid from the at least one conduit is routed through the at least one jet.

According to a further embodiment, the process further comprises the step of rotationally positioning the at least one jet within the at least one conduit.

According to a further embodiment, the number of the conduits is two and the number of the jets is two.

According to a further embodiment, the process further comprises the step of positioning the fluid flows discharged by the two jets such that the fluid flows interact.

According to a further embodiment, the process further comprises the step of rotationally aligning the two jets such that the fluid flows from both jets are aligned.

According to one embodiment, there is provided an apparatus for mixing one or more materials with a base fluid in a venturi hopper of the type having a base fluid inlet, a material funnel, a substantially vertical hopper throat, a hopper throat valve, a mixing chamber, a jet, and a venturi discharge, comprising: the mixing chamber, the mixing chamber having a vacuum inlet, the vacuum inlet being positioned to discharge the one or more materials into the mixing chamber; and the hopper throat, the hopper throat having a throat inlet, the throat inlet being positioned to discharge a fluid into the hopper throat proximate the hopper throat valve.

According to a further embodiment, the apparatus further comprises a vacuum inlet line, for routing materials to the vacuum inlet, and a vacuum inlet line valve.

According to a further embodiment, the vacuum inlet line valve is a ball valve.

According to a further embodiment, the vacuum inlet line valve is a regulating valve for adjusting the rate of material entry through the vacuum inlet.

According to a further embodiment, the apparatus further comprises a vacuum inlet line check valve positioned on the vacuum inlet line between the vacuum inlet and the vacuum inlet line valve, the vacuum inlet line check valve being attached to prevent flow from the materials addition device through the vacuum inlet line valve.

According to a further embodiment, the apparatus further comprises a suction hose and a suction hose valve, the suction hose being attached to the vacuum inlet, the suction hose valve being positioned such that the suction hose becomes open to the atmosphere when the suction hose valve is open.

According to a further embodiment, the fluid discharged by the throat inlet is substantially the same as the base fluid and from a common source.

According to a further embodiment, the apparatus further comprises a valved throat inlet line for delivering the base fluid to the throat inlet from the common source.

According to a further embodiment, the fluid discharged by the throat inlet is not the same as the base fluid.

According to a further embodiment, the apparatus further comprises a valved throat inlet line for delivering the fluid to the throat inlet.

According to a further embodiment, the apparatus further comprises the jet, the jet being detachable.

According to a further embodiment, the apparatus further comprises the venturi hopper, the venturi hopper further having a detachable side portion, the side portion's removal allowing access to the jet.

According to a further embodiment, the vacuum inlet is further positioned such that the one or more materials are discharged into the mixing chamber along a path, which intersects the path of the jetted fluid.

According to one embodiment, there is provided an apparatus for mixing one or more materials with a fluid in a venturi hopper of the type having a fluid inlet, a material funnel, a substantially vertical hopper throat, a hopper throat valve, a mixing chamber, a jet, and a venturi discharge, comprising: means for isolating the material funnel from fluid communication with the mixing chamber; means for receiving the base fluid through the fluid inlet; means for jetting the base fluid from the jet, through the mixing chamber, and into the venturi discharge; means for drawing the one or more materials into the mixing chamber through a vacuum inlet, such that the one or more materials enter into the mixing chamber; and means for receiving a fluid into the hopper throat through a throat inlet.

According to a further embodiment, the means for receiving a fluid through the throat inlet further comprises means for directing such throat inlet fluid flow into an area proximate the hopper throat valve.

According to a further embodiment, the apparatus further comprises means for routing the base fluid to both the fluid inlet and the throat inlet from a common source.

According to a further embodiment, the apparatus further comprises means for routing a fluid other than the base fluid to the throat inlet.

According to a further embodiment, the means for drawing the one or more materials into the mixing chamber through a vacuum inlet further comprises means for regulating the rate at which the materials enter the mixing chamber.

According to a further embodiment, the means for regulating the rate at which the materials enter the mixing chamber further comprises means for varying the jetting rate.

According to a further embodiment, the means for drawing the one or more materials into the mixing chamber through a vacuum inlet further comprises means for routing materials to the vacuum inlet.

According to a further embodiment, the apparatus further comprises means for vacuuming the one or more materials or other accumulations, from one or more exterior surfaces, such that the vacuumed materials or accumulations are drawn into the mixing chamber.

According to a further embodiment, the means for drawing the one or more materials into the mixing chamber through the vacuum inlet further comprises means for directing the drawn materials such that all or part of such drawn materials enter the mixing chamber along a path which intersects the path of the jetted fluid.

According to a further embodiment, the apparatus further comprises means for detaching the jet.

According to a further embodiment, the apparatus further comprises means for accessing the jet.

According to one embodiment, there is a process for mixing one or more materials with a fluid in a venturi hopper of the type having a fluid inlet, a material funnel, a substantially vertical hopper throat, a hopper throat valve, a mixing chamber, a jet, and a venturi discharge, comprising the steps of: isolating the material funnel from fluid communication with the mixing chamber; receiving the base fluid through the fluid inlet; jetting the base fluid from the jet, through the mixing chamber, and into the venturi discharge; drawing the one or more materials into the mixing chamber through a vacuum inlet, the one or more materials entering into the mixing chamber; and receiving a fluid into the hopper throat through a throat inlet.

According to a further embodiment, the step of receiving a fluid through the throat inlet further comprises the step of directing such throat inlet fluid flow into an area proximate the hopper throat valve.

According to a further embodiment, the process further comprises the step of routing the base fluid to both the fluid inlet and the throat inlet from a common source.

According to a further embodiment, the process further comprises the step of routing a fluid other than the base fluid to the throat inlet.

According to a further embodiment, the step of drawing the one or more materials into the mixing chamber through a vacuum inlet further comprises the step of regulating the rate at which the materials enter the mixing chamber.

According to a further embodiment, the step of regulating the rate at which the materials enter the mixing chamber further comprises the step of varying the jetting rate.

According to a further embodiment, the process further comprises the step of vacuuming the one or more materials or other accumulations, from one or more exterior surfaces, such that the vacuumed materials or accumulations are drawn into the mixing chamber.

According to a further embodiment, the step of drawing the one or more materials into the mixing chamber through the vacuum inlet further comprises the step of directing the drawn materials such that all or part of such drawn materials enter the mixing chamber along a path which intersects the path of the jetted fluid.

According to a further embodiment, the step of drawing the one or more materials into the mixing chamber through a vacuum inlet further comprises the step of routing materials to the vacuum inlet.

According to one embodiment, there is provided an apparatus for mixing one or more bulk materials with a fluid in a venturi hopper of the type having a fluid inlet, a material funnel, a substantially vertical hopper throat, a hopper throat valve, a mixing chamber, a jet, and a venturi discharge, comprising: the mixing chamber, the mixing chamber having a bulk materials port, the bulk materials port being positioned to discharge the one or more materials into the mixing chamber; and the hopper throat, the hopper throat having a throat inlet, the throat inlet being positioned to discharge a fluid into the hopper throat.

According to a further embodiment, the throat inlet is positioned to discharge a fluid proximate the hopper throat valve.

According to a further embodiment, the apparatus further comprises a blind flange, the blind flange being interchangeable with either or both of the hopper throat valve and the material funnel, such that the hopper throat is sealed.

According to a further embodiment, the throat inlet is positioned to discharge a fluid proximate the blind flange.

According to a further embodiment, the apparatus further comprises a flange, the flange being interchangeable with either or both of the hopper throat valve and the material funnel, such that the hopper throat is sealable.

According to a further embodiment, the throat inlet is positioned to discharge a fluid proximate the flange.

According to a further embodiment, the venturi hopper is installable such that the hopper throat has a non-vertical orientation.

According to a further embodiment, the apparatus further comprises a throat inlet line, and a throat inlet line valve, the throat inlet line being attached to a source of fluid for receiving such fluid and routing the fluid to the hopper throat inlet.

According to a further embodiment, the fluid is received is substantially the same as the fluid received by the venturi hopper fluid inlet.

According to a further embodiment, the fluid is received is different than the fluid received by the venturi hopper fluid inlet.

According to a further embodiment, the apparatus further comprises a bulk material port line, and a bulk material port line regulating valve on such bulk material port line, the bulk material port line being attached to the bulk material port, the bulk material port line regulating valve allowing the rate of material entry through the bulk material port line to be regulated.

According to a further embodiment, the bulk material port is positioned such that all or part of such drawn materials enter the mixing chamber along a path which intersects the path of the jetted fluid.

According to one embodiment, there is provided an apparatus for mixing one or more bulk materials with a fluid in a venturi hopper of the type having a fluid inlet, a material funnel, a substantially vertical hopper throat, a hopper throat valve, a mixing chamber, a jet, and a venturi discharge, comprising: means for receiving the base fluid through the fluid inlet; means for jetting the base fluid from the jet, through the mixing chamber, and into the venturi discharge;

means for drawing the one or more bulk materials into the mixing chamber through a bulk materials port, the one or more bulk materials entering into the mixing chamber; and means for receiving a fluid into the hopper throat through a throat inlet.

According to a further embodiment, the means for receiving a fluid through the throat inlet further comprises means for directing such throat inlet fluid flow into an area proximate the hopper throat valve.

According to a further embodiment, the apparatus further comprises means for closing the hopper throat in addition to the hopper throat valve.

According to a further embodiment, the means for receiving a fluid through the hopper throat inlet further comprises means for directing such hopper throat inlet fluid flow into an area proximate the hopper throat valve.

According to a further embodiment, the apparatus further comprises means for rotating the venturi hopper prior to receiving the fluid in the venturi hopper.

According to a further embodiment, the apparatus further comprises means for routing the base fluid to both the fluid inlet and the hopper throat inlet from a common source.

According to a further embodiment, the apparatus further comprises means for routing a fluid other than the base fluid to the throat inlet.

According to a further embodiment, the means for drawing the one or more bulk materials into the mixing chamber through a bulk materials port further comprises means for regulating the rate at which the materials enter the mixing chamber.

According to a further embodiment, the means for regulating the rate at which the materials enter the mixing chamber further comprises means for varying the jetting rate.

According to a further embodiment, the means for drawing the one or more bulk materials into the mixing chamber through the bulk materials port further comprises means for directing the drawn materials such that all or part of such drawn materials enter the mixing chamber along a path which intersects the path of the jetted fluid.

According to one embodiment, there is a process for mixing one or more bulk materials with a fluid in a venturi hopper of the type having a fluid inlet, a material funnel, a substantially vertical hopper throat, a hopper throat valve, a mixing chamber, a jet, and a venturi discharge, comprising the steps of: closing the hopper throat; receiving the base fluid through the fluid inlet; jetting the base fluid from the jet, through the mixing chamber, and into the venturi discharge; drawing the one or more bulk materials into the mixing chamber through a bulk materials port, the one or more bulk materials entering into the mixing chamber; and receiving a fluid into the hopper throat through a throat inlet.

According to a further embodiment, the step of closing the hopper throat further comprises the step of flanging the hopper throat such that the hopper throat is sealable.

According to a further embodiment, the step of receiving a fluid through the hopper throat inlet further comprises the step of directing such hopper throat inlet fluid flow into an area proximate and beneath the hopper throat valve.

According to a further embodiment, the process further comprises the step of rotating the venturi hopper prior to receiving the fluid into the venturi hopper.

According to a further embodiment, the process further comprises the step of routing the base fluid to both the fluid inlet and the hopper throat inlet from a common source.

According to a further embodiment, the process further comprises the step of routing a fluid other than the base fluid to the throat inlet.

According to a further embodiment, the step of drawing the one or more bulk materials into the mixing chamber through a bulk materials port further comprises the step of regulating the rate at which the materials enter the mixing chamber.

According to a further embodiment, the step of regulating the rate at which the materials enter the mixing chamber further comprises the step of varying the jetting rate.

According to a further embodiment, the step of drawing the one or more bulk materials into the mixing chamber through the bulk materials port further comprises the step of directing the drawn materials such that all or part of such drawn materials enter the mixing chamber along a path which intersects with the path of the jetted fluid.

According to one embodiment, there is provided an apparatus for mixing one or more bulk materials with a fluid in an eductor assembly of the type having a fluid inlet, a jet, a mixing chamber, and a diffuser, such that the fluid is jetted from the jet, through the mixing chamber, and into the diffuser, and a bulk materials entry throat through which bulk materials enter the mixing chamber, comprising: the mixing chamber, the mixing chamber having a bulk materials port, the bulk materials port being positioned to discharge the one or more materials into the mixing chamber; and the bulk materials entry throat, the bulk materials entry throat having a throat inlet, the throat inlet being positioned to discharge a fluid into the bulk materials entry throat.

According to a further embodiment, the throat inlet is positioned to discharge a fluid proximate the top of the bulk materials entry throat.

According to a further embodiment, the apparatus further comprises a blind flange, the blind flange being attached to the eductor assembly such that the bulk materials entry throat is sealed.

According to a further embodiment, the throat inlet is positioned to discharge a fluid proximate the blind flange.

According to a further embodiment, the apparatus further comprises a flange, the flange being attached to the eductor assembly such that the bulk materials entry throat is sealable.

According to a further embodiment, the throat inlet is positioned to discharge a fluid proximate the flange.

According to a further embodiment, the eductor assembly is installable such that the bulk materials entry throat has a non-vertical orientation.

According to a further embodiment, the apparatus further comprises a throat inlet line, and a throat inlet line valve, the throat inlet line being attached to a source of fluid for receiving such fluid and routing the fluid to the bulk material entry throat inlet.

According to a further embodiment, the fluid is received is substantially the same as the fluid received by the eductor assembly fluid inlet.

According to a further embodiment, the fluid is received is different than the fluid received by the eductor assembly fluid inlet.

According to a further embodiment, the apparatus further comprises a bulk material port line, and a bulk material port line regulating valve on such bulk material port line, the bulk material port line being attached to the bulk material port, the bulk material port line regulating valve allowing the rate of material entry through the bulk material port line to be regulated.

According to a further embodiment, the bulk material port is positioned such that all or part of such drawn materials enter the mixing chamber along a path which intersects the path of the jetted fluid.

According to one embodiment, there is provided an apparatus for mixing one or more bulk materials with a fluid in an eductor assembly of the type having a fluid inlet, a jet, a mixing chamber, and a diffuser, such that the fluid is jetted from the jet, through the mixing chamber, and into the diffuser, and a bulk materials entry throat through which bulk materials enter the mixing chamber, comprising: means for closing the bulk materials entry throat; means for receiving the base fluid through the fluid inlet; means for drawing the one or more bulk materials into the mixing chamber through a bulk materials port, the one or more bulk materials entering into the mixing chamber; and means receiving a fluid into the bulk materials entry throat through a throat inlet.

According to a further embodiment, the means for closing the bulk material entry throat further comprises means for flanging the bulk materials entry throat such that the bulk materials entry throat is sealable.

According to a further embodiment, the means for receiving a fluid through the throat inlet further comprises means for directing such throat inlet fluid flow into an area proximate the top of the bulk materials entry throat.

According to a further embodiment, the apparatus further comprises means for rotating the eductor assembly prior to receiving the fluid in the eductor assembly.

According to a further embodiment, the apparatus further comprises means for routing the base fluid to both the fluid inlet and the throat inlet from a common source.

According to a further embodiment, the apparatus further comprises means for routing a fluid other than the base fluid to the throat inlet.

According to a further embodiment, the means for drawing the one or more bulk materials into the mixing chamber through a bulk materials port, further comprises means for regulating the rate at which the materials enter the mixing chamber.

According to a further embodiment, the means for regulating the rate at which the materials enter the mixing chamber further comprises means for varying the jetting rate.

According to a further embodiment, the means for drawing the one or more bulk materials into the mixing chamber through the bulk materials port, further comprises means for directing the drawn materials such that all or part of such drawn materials enter the mixing chamber along a path which intersects the patch of the jetted fluid.

According to one embodiment, there is a process for mixing one or more bulk materials with a fluid in an eductor assembly of the type having a fluid inlet, a jet, a mixing chamber, and a diffuser, such that the fluid is jetted from the jet, through the mixing chamber, and into the diffuser, and a bulk materials entry throat through which bulk materials enter the mixing chamber, comprising the steps of: closing the bulk materials entry throat; receiving the base fluid through the fluid inlet; drawing the one or more bulk materials into the mixing chamber through a bulk materials port, the one or more bulk materials entering into the mixing chamber; and receiving a fluid into the bulk materials entry throat through a throat inlet.

According to a further embodiment, the step of closing the bulk material entry throat further comprises the step of flanging the bulk materials entry throat such that the bulk materials entry throat is sealable.

According to a further embodiment, the step of receiving a fluid through the throat inlet further comprises the step of directing such throat inlet fluid flow into an area proximate the top of the bulk materials entry throat.

According to a further embodiment, the process further comprises the step of rotating the eductor assembly prior to receiving the fluid into the eductor assembly.

According to a further embodiment, the process further comprises the step of routing the base fluid to both the fluid inlet and the throat inlet from a common source.

According to a further embodiment, the process further comprises the step of routing a fluid other than the base fluid to the throat inlet.

According to a further embodiment, the step of drawing the one or more bulk materials into the mixing chamber through a bulk materials port further comprises the step of regulating the rate at which the materials enter the mixing chamber.

According to a further embodiment, the step of regulating the rate at which the materials enter the mixing chamber further comprises the step of varying the jetting rate.

According to a further embodiment, the step of drawing the one or more bulk materials into the mixing chamber through the bulk materials port further comprises the step of directing the drawn materials such that all or part of such drawn materials enter the mixing chamber along a path which intersects the patch of the jetted fluid.

According to one embodiment, there is provided an improved venturi hopper, of the type having a jet and a mixing chamber, the improvement comprising the venturi hopper, the venturi hopper having a detachable side portion, such that the jet is accessible when the side portion is removed.

According to a further embodiment, the apparatus further comprises the side inspection plate, the side inspection plate having a vacuum inlet, the vacuum inlet being positioned on the side inspection plate for discharging one or more materials into the mixing chamber.

According to one embodiment, there is provided an apparatus for providing access to the venturi jet in a venturi hopper, comprising: means for removing a side portion of the venturi hopper proximate the venturi jet; means for removing the venturi jet; means for replacing the venturi jet with a new or serviced venturi jet; and means for attaching the side portion of the venturi hopper.

According to one embodiment, there is a process for replacing or servicing the venturi jet in a venturi hopper, comprising the steps of: removing a side portion of the venturi hopper proximate the venturi jet; removing the venturi jet; replacing the venturi jet with a new or serviced venturi jet; and attaching the side portion of the venturi hopper.

According to one embodiment, there is provided an improved eductor assembly, of the type having a jet and a mixing chamber, the improvement comprising the eductor assembly, the venturi hopper having a detachable side portion, such that the jet is accessible when the side portion is removed.

According to a further embodiment, the apparatus further comprises the side inspection plate, the side inspection plate having a vacuum inlet, the vacuum inlet being positioned on the side inspection plate for discharging one or more materials into the mixing chamber.

According to one embodiment, there is provided an apparatus for providing access to the jet in an eductor assembly, comprising: means for removing a side portion of the eductor assembly proximate the venturi jet; means for removing the jet; means for replacing the jet with a new or serviced jet; and means for attaching the side portion of the eductor assembly.

According to one embodiment, there is a process for replacing or servicing the jet in an eductor assembly, comprising the steps of: removing a side portion of the eductor assembly proximate the jet; removing the jet; replacing the jet with a new or serviced jet; and attaching the side portion of the eductor assembly.

According to one embodiment, there is provided an apparatus for handling and preparing a fluid, comprising: a materials addition device, for receiving and adding one or more materials to the fluid; a shearing devices combination, having a high velocity shearing means and a low velocity shearing means, for shearing fluid; an inlet for receiving the fluid; an outlet for discharging the fluid; a first pipe and valve combination for routing the fluid from the inlet through the materials addition device, then through the discharge outlet; a second pipe and valve combination, cooperating with the first pipe and valve combination, for routing the fluid from the inlet through the materials addition device, through the shearing devices combination, then through the discharge outlet; and a third pipe and valve combination cooperating with the first and second pipe and valve combinations for routing the fluid from the inlet through the shearing devices combination then through the discharge outlet.

According to a further embodiment, the materials addition device further comprises a first bulk material port for receiving one or more materials into the materials addition device.

According to a further embodiment, the materials addition device further comprises a vacuum inlet for receiving one or more materials into the materials addition device.

According to a further embodiment, the materials addition device further comprises a second bulk material port for receiving one or more bulk materials into the materials addition device.

According to a further embodiment, the materials addition device further comprises a detachable side portion, the second bulk material port being positioned on the side portion.

According to a further embodiment, the first bulk material port further comprises a material funnel for receiving one or more materials into the materials addition device.

According to a further embodiment, the materials addition device further comprises a venturi hopper.

According to a further embodiment, the materials addition device further comprises an eductor assembly.

According to a further embodiment, the high velocity shearing device further comprises a plurality of conduits, each such conduit having a first end and a second end, the conduit first ends being positioned such that, as the fluid flows through the fluid shearing device, the fluid is diverted into the first ends of the plurality of conduits, and is discharged from the conduit second ends, the conduit second ends being positioned to discharge the fluid in opposing flows as the conduits are rejoined, such that all or some of the fluid in the opposing flows interacts.

According to a further embodiment, the apparatus further comprises a jet, the jet being positioned within at least one of the plurality of conduits such that the fluid in such at least one conduit is jetted as it is discharged from the second end of such at least one conduit.

According to a further embodiment, the apparatus further comprises a plurality of jets, each jet being positioned within one of the plurality of conduits such that the fluid in each conduit is jetted as it is discharged from the second end of each such conduit.

According to a further embodiment, the apparatus further comprises the plurality of jets, at least one of such jets further comprising a jet insert, the jet insert having a first end and a second end, the jet insert also having a plurality of bores extending from the jet insert first end toward the jet insert second end, each bore having an increasing cross-sectional area from the jet insert first end to the jet insert second end.

According to a further embodiment, the cross-sectional areas of the bores increase to such an extent that such cross-sectional areas overlap, resulting in the merger of the bores.

According to a further embodiment, the number of bores beginning at the jet insert first end is four.

According to a further embodiment, the apparatus further comprises the plurality of conduits, at least two such conduits having a conduit key attached within each such at least two conduits, and at least two of the jet inserts, each such jet insert having a key slot which corresponds to the conduit keys, such that when each of the at least two jet inserts are positioned within each of the at least two conduits, each of the plurality of bores on each of the at least two jet inserts, aligns with one of the plurality of bores on another of the at least two jet inserts.

According to a further embodiment, the apparatus further comprises the plurality of conduits, at least one of such conduits having a jet insert seat for seating and positioning the jet insert within the conduit, the jet insert seat comprising a ring attached within the conduit such that the jet insert second end is adjacent the ring.

According to a further embodiment, the apparatus further comprises the jet insert seat ring, the ring having an internal diameter, which is tapered toward the conduit second end.

According to a further embodiment, the apparatus further comprises the jet insert seat ring, the ring having an internal diameter, which is partially tapered toward the conduit second end.

According to a further embodiment, the apparatus further comprises the plurality of conduits, at least one of such conduits having a circumferential groove within such conduit, the groove being proximate the jet insert first end, and at least one snap ring, the snap ring being sized to be closely received by such conduit groove, such that the jet insert is secured within the conduit.

According to a further embodiment, the apparatus further comprises an O-ring positioned between each jet insert and conduit, sealing each such jet insert, such that fluid flow in each such conduit is routed through each such jet insert.

According to a further embodiment, the conduits rejoin at an angle such that the discharged fluid flows are substantially in-line.

According to a further embodiment, the conduits rejoin at an angle such that the discharged fluid flows are only partially opposing.

According to a further embodiment, the apparatus further comprises the plurality of conduits, at least one such conduit having a closable removal tool port, the removal tool port being positioned such that a removal tool can be inserted into such conduit.

According to a further embodiment, the removal tool port is positioned with respect to the at least one conduit such that a substantially straight tool enters such conduit along a path which is substantially parallel to the longitudinal axis of such conduit.

According to a further embodiment, the low velocity shearing means comprises at least one shear plate, the at least one shear plate being positioned within the velocity shearing means such that the fluid passes through the at least one shear plate as the fluid moves through the low velocity shearing means.

According to a further embodiment, the low velocity shearing means comprises at least one static mixer, the at least one static mixer plate being positioned within the low velocity shearing device such that the fluid passes through the at least one static mixer as the fluid moves through the low velocity shearing device.

According to a further embodiment, the low velocity shearing means comprises at least one shear plate and at least one static mixer, the at least one static mixer plate being positioned within the low velocity shearing means such that the fluid passes through the at least one shear plate and the at least one static mixer as the fluid moves through the low velocity shearing means.

According to one embodiment there is provided an apparatus for handling and preparing a fluid, comprising: means for receiving the fluid through an inlet; means for routing the fluid through a combination shearing device, the combination shearing device having a first shearing device and a second shearing device; means for alternately routing the fluid through the first shearing device or the second shearing device; and means for routing the fluid through a discharge outlet.

According to one embodiment, there is provided an apparatus for handling and preparing a fluid, comprising: means for receiving the fluid through an inlet; means for routing the fluid through a combination shearing device, the combination shearing device having high velocity shearing means and low velocity shearing means, means for alternately routing the fluid through the high velocity shearing means or the low velocity shearing means of the combination shearing device; and means for routing the fluid through a discharge outlet.

According to a further embodiment, the apparatus further comprises means for routing the fluid through a materials addition device.

According to a further embodiment, the apparatus further comprises means for bypassing the materials addition device.

According to a further embodiment, the apparatus further comprises means for bypassing the materials addition device and the combination shearing device.

According to a further embodiment, the apparatus further comprises means for receiving one or more materials into the fluid as the fluid moves through the materials addition device.

According to a further embodiment, the means for receiving one or more materials further comprises means for receiving the one or more materials through a material funnel, the material funnel being positioned on the materials addition device in a substantially vertical position.

According to a further embodiment, the means for receiving one or more materials further comprises means for receiving the one or more materials through a vacuum inlet, the vacuum inlet being positioned on the materials addition device such that received materials enter the materials addition device and mix with the fluid.

According to a further embodiment, the means for receiving the one or more materials through a vacuum inlet further comprises means for routing materials to the vacuum inlet.

According to a further embodiment, the means for receiving one or more materials further comprises means for receiving the one or more materials through either of two bulk material ports, each of the two bulk material ports being positioned on the materials addition device such that received materials enter the materials addition device and mix with the fluid.

According to a further embodiment, the apparatus further comprises means for bypassing the combination shearing device.

According to a further embodiment, the means for routing the fluid through the high velocity shearing portion further comprises means for dividing the fluid into a plurality of flows, then rejoining such plurality of flows into a single flow.

According to a further embodiment, the means for dividing and rejoining the fluid flow further comprises means for jetting the fluid in at least one of such fluid flows.

According to a further embodiment, the means for dividing and rejoining the fluid flow further comprises means for rejoining the flows such that the fluid from each of such flows interacts with the fluid from at least one other of such flows as such flows rejoin.

According to a further embodiment, the means for dividing and rejoining the fluid flow, further comprises means for jetting the fluid within each of flows such that the jetted fluid interacts with the jetted fluid from at least one other of such flows as the fluid is being rejoined.

According to a further embodiment, the means for jetting the fluid within each of such fluid flows further comprises: means for diverting the fluid within each such flow into a plurality of sub-flows; and means for tapering each of such sub-flow's cross-sectional area to the point of jetting.

According to a further embodiment, the number of sub-flows in each such flow is four.

According to a further embodiment, the means for diverting the fluid within each such flow into a plurality of sub-flows, further comprises means for aligning each jetted sub-flow in the plurality of sub-flows in one of the plurality of flows, with one of the jetted sub-flows in the plurality of sub-flows in another of the plurality of flows.

According to a further embodiment, the means for routing the fluid through the low velocity shearing portion further comprises means for routing the fluid through at least one shear plate.

According to a further embodiment, the means for routing the fluid through the low velocity shearing portion further comprises means for routing the fluid through at least one static mixer.

According to a further embodiment, the means for routing the fluid through the velocity shearing means further comprises means for routing the fluid through at least one static mixer and at least one shear plate.

According to a further embodiment, the apparatus further comprises means for inserting a tool into the shearing device, the direction of the tool insertion being along the longitudinal axis of the high velocity shearing portion.

According to one embodiment, there is a process for handling and preparing a fluid, comprising the steps of:

receiving the fluid through an inlet; routing the fluid to a combination shearing device, the combination shearing device having high velocity shearing means and a low velocity shearing means, then routing the fluid through the high velocity shearing portion or through the low velocity shearing means, and routing the fluid through a discharge outlet.

According to a further embodiment, the process further comprises the step of routing the fluid through a materials addition device prior to routing the fluid through the combination shearing device.

According to a further embodiment, the process further comprises the step of bypassing the materials addition device, if desired.

According to a further embodiment, the process further comprises the steps of bypassing the materials addition device and the combination shearing device, if desired.

According to a further embodiment, the process further comprises the step of receiving one or more materials into the fluid as the fluid moves through the materials addition device.

According to a further embodiment, the step of receiving one or more materials further comprises the step of receiving the one or more materials through a first bulk material port, the bulk material port being positioned on the materials addition device such that received materials enter the materials addition device.

According to a further embodiment, the step of receiving one or more materials further comprises the step of receiving the one or more materials through either of two bulk material ports, each of the two bulk material ports being positioned on the materials addition device such that received materials enter the materials addition device and mix with the fluid.

According to a further embodiment, the step of receiving one or more materials further comprises the step of receiving the one or more materials through a material funnel, the material funnel being positioned on the materials addition device in a substantially vertical position.

According to a further embodiment, the step of receiving one or more materials further comprises the step of receiving the one or more materials through a vacuum inlet, the vacuum inlet being positioned on the materials addition device such that received materials enter the materials addition device and mix with the fluid.

According to a further embodiment, the step of receiving the one or more materials through a vacuum inlet further comprises the step of routing materials to the vacuum inlet.

According to a further embodiment, the process further comprises the step of bypassing the combination shearing device, if desired.

According to a further embodiment, the routing the fluid through the high velocity shearing portion step further comprises the step of routing the fluid through a plurality of conduits, the plurality of conduits then rejoining to a single conduit.

According to a further embodiment, the routing the fluid through a plurality of conduits step further comprises the step of jetting the fluid within at least one of such conduits.

According to a further embodiment, the routing the fluid through a plurality of conduits step further comprises the step of discharging the fluid from the plurality of conduits such that the fluid from each of such conduits interacts with the fluid from at least one other of such conduits as such conduits rejoin.

According to a further embodiment, the discharging the fluid from a plurality of conduits step further comprises the step of jetting the fluid within each of such conduits such that the jetted fluid interacts with the jetted fluid from at least one other of such conduits as the fluid is being discharged.

According to a further embodiment, the step of jetting the fluid within each of such conduits further comprises the steps of: diverting the fluid within each such conduit into a plurality of flows; and tapering each such flow's cross-sectional area to the point of jetting.

According to a further embodiment, the number of flows in each conduit is four.

According to a further embodiment, the step of diverting the fluid within each such conduit into a plurality of flows, further comprises the step of aligning each jetted flow in the plurality of flows in one of the plurality of conduits, with one of the jetted flows in the plurality of flows in another of the plurality of conduits.

According to a further embodiment, the routing the fluid through the low velocity shearing portion step further comprises the step of routing the fluid through at least one shear plate.

According to a further embodiment, the routing the fluid through the low velocity shearing portion step further comprises the step of routing the fluid through at least one static mixer.

According to a further embodiment, the routing the fluid through the low velocity shearing portion step further comprises the step of routing the fluid through at least one static mixer and at least one shear plate.

According to one embodiment, there is provided an apparatus for handling and preparing a fluid, comprising: an inlet, the inlet being positioned to receive the fluid; a materials addition device, the materials addition device having a first end and a second end, the materials addition device being configured such that one or more materials may be added to the fluid; a shearing device, the shearing device having a first end and a second end; an outlet, the discharge outlet being positioned to discharge flowing fluid; a first conduit branch and a second conduit branch, the first conduit branch having a first and second valve, and the second conduit branch having a first and second valve, the first conduit branch and first conduit branch first and second valves being positioned such that fluid communication is established between the inlet and the materials addition device first end or, alternatively between the inlet and the second conduit branch, the second conduit branch and the second conduit branch first and second valves being positioned such that fluid communication is established between the first conduit branch and the shearing device second end or, alternatively, the first conduit branch and the discharge outlet; and a third conduit branch, the third conduit branch having a first and second valve, the third conduit branch and the third conduit branch first and second valves being positioned such that fluid communication is established between the materials addition device second end and the discharge outlet or, alternatively, between the materials addition device second end and the shearing device first end.

BRIEF DESCRIPTION OF THE DRAWINGS

FIGS. 5*a* and 5*c* are end views of the jet insert. FIG. 5*b* is a cut away side view of the jet insert. FIG. 5*d* is a cut away top view of the installed jet insert.

FIG. 6*a* is a side view. FIG. 6*b* is an end view.

FIG. 7*a* is an end view. FIG. 7*b* is a side view.

DETAILED DESCRIPTION

Figure 1:
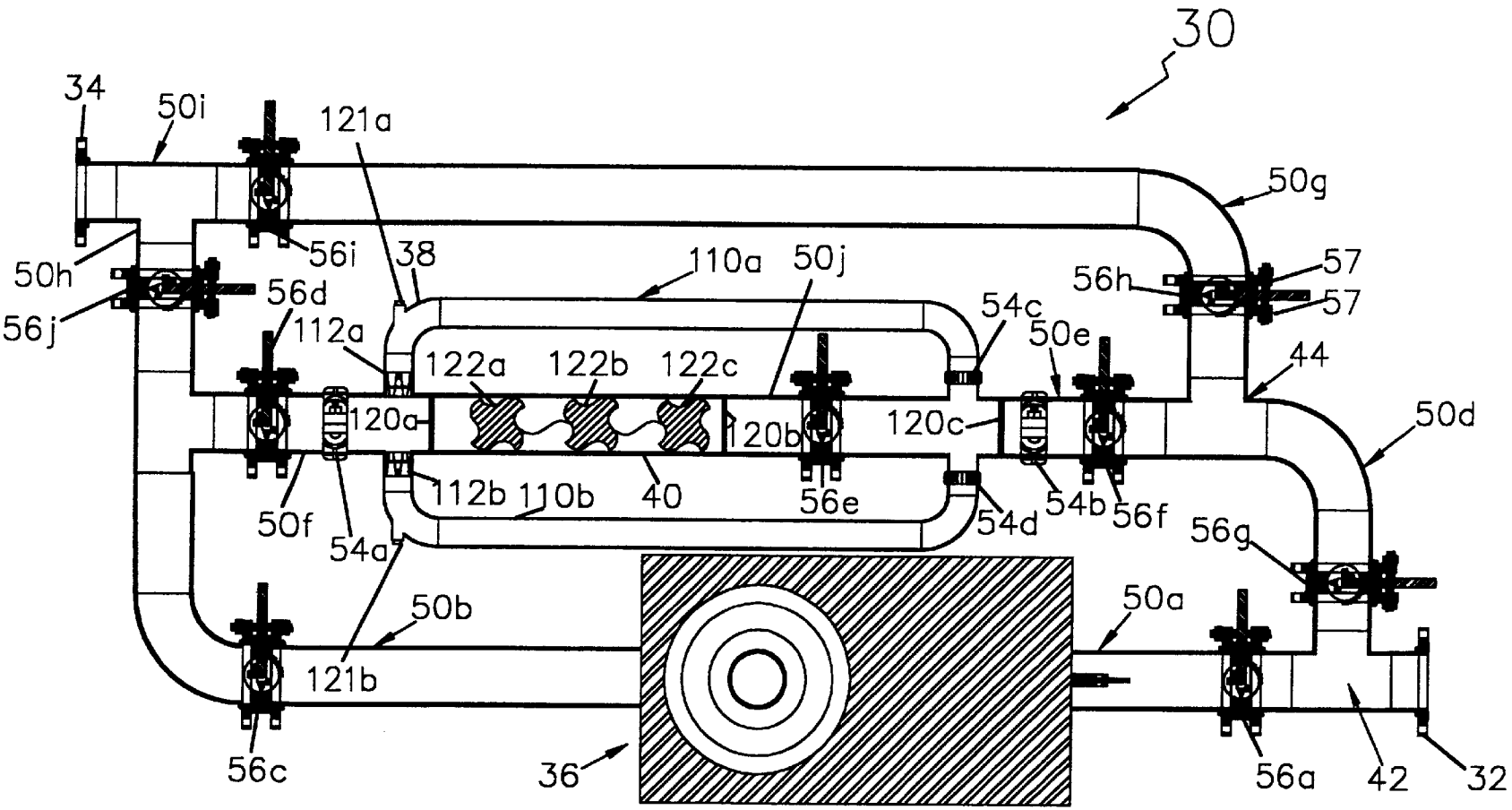
FIG. 1 is a top view of an embodiment.

An example embodiment of our invention 30 is depicted in FIGS. 1–7*b*, wherein an inlet 32, an outlet 34, a materials addition device 36 and a combination first shearing device 38 and second shearing device 40 are cooperatively interconnected by a first conduit branch 42, second conduit branch 44, and third conduit branch 46, the first, second and third conduit branches 42,44,46 having both pipe sections 50*a–j*, materials addition device flanges 52*a–b*, victaulic connections 54*a–d*, valves 56*a–j*, and valve flanges 57. In this example embodiment the pipe 50 is six inch Schedule 40 steel. The valves 56*a–j* are six inch internal diameter butterfly valves, with oil resistant trim, mounted between six inch slip on flanges 57 with ANSI rating of 150 psi. The flange 52*b* in the material addition device 36 is a six inch slip on blind flange, bored to receive a three inch pipe section 53. This three inch pipe section 53 is Schedule 80 steel. The remainder of flange 52*b* is a six inch slip on flange. The victaulic connections 54*a–b* are either three inch or six inch internal diameter style 77 victaulic clamps.

The materials addition device 36 in this example embodiment is a particular type of an eductor assembly known as a venturi hopper 70 wherein materials can be added through a material funnel 72, the materials descending from the material funnel 72 hopper through a hopper throat 74 and hopper throat valve 56*b*, into a mixing chamber 76. Fluid entering the materials addition device 36,70 is jetted by a replaceable jet 78, which jets the fluid through the mixing chamber 76 into a venturi discharge 80. The mixing chamber 76 is eight inch Schedule 40 steel, with both ends reduced to six inches for connection to flanges 52*a–b*. The replaceable two inch jet 78 and the venturi discharge 80 are 4140 high tensile steel. The jet 78 screws into the three inch pipe section 53. The six inch pipe section 50*a* reduces to the three inch pipe section 53.

It is anticipated that this embodiment will efficiently handle fluid entry rates of approximately 600 to 1000 gallons per minute of water, depending on the choice of high shear or low shear options. For higher or lower rates, it is anticipated that a proportionately resized jet 78 and pipe sections 50*a–j* will allow proportionately equivalent rates. For example, it is anticipated that a four inch piping arrangement, using a one and one-half inch jet would efficiently handle fluid entry rates of approximately 400 to 650 gallons per minute of water. This embodiment is also anticipated to perform efficiently with fluid pumps delivering 85 to 120 feet of head, based on fresh water.

In this example embodiment, materials may also be added through a vacuum inlet 82, which is positioned to discharge materials into the mixing chamber 76. Materials are routed to the vacuum inlet 82 through a vacuum inlet line 84, which has a vacuum inlet line check valve 85, a vacuum inlet line ball valve 86, and a detachable vacuum inlet 88, on the upstream side of the vacuum inlet line valve 86. The vacuum inlet 82 and vacuum inlet line 84 are sized to receive both liquid and powder materials, in sufficient volumes, to enable high volumes of jetted fluid to receive appropriate amounts of the materials. As discussed above, the jetted fluid rate can be estimated to be between 600 to 1000 gallons per minute, requiring, in many cases, that the vacuum inlet 82 discharge powdered polymers at rates of approximately 50 pounds per minute. Accordingly, it is anticipated that a vacuum inlet 82 having an internal diameter of one and one-half inches will be sufficient. Because the material primarily enters the mixing chamber 76 through vacuum inlet 82 as a result of the vacuum generated by the jetted fluid, the rate of material entry can be regulated by modifying the jetted fluid rate. In an alternate embodiment (not shown), a one and one-half inch diaphragm valve is substituted for the one and one-half inch vacuum inlet line ball valve 86, which provides additional regulation of the rate of material entry through the vacuum inlet 82.

Figure 4:
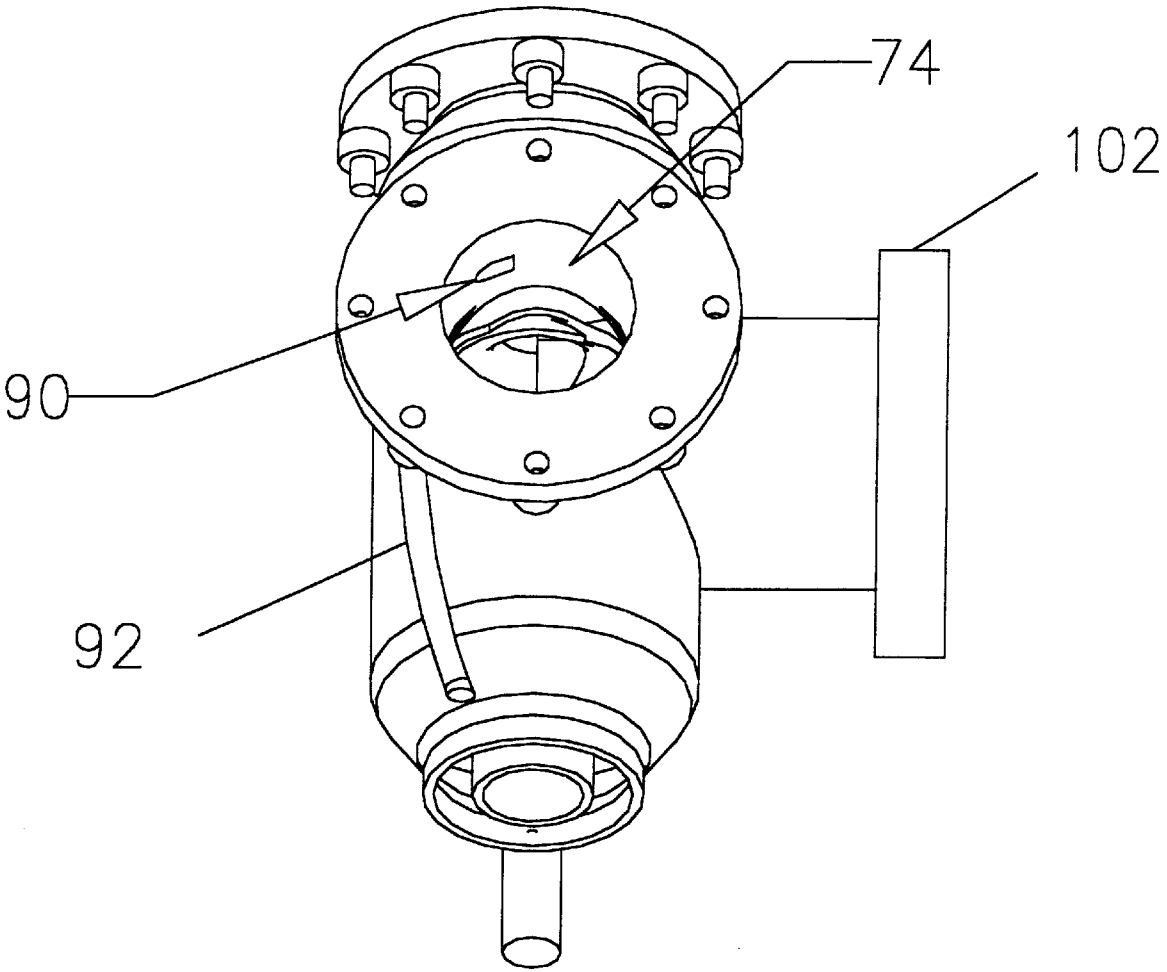
FIG. 4 is an oblique view of the hopper throat inlet in an embodiment.

In this example embodiment, the fluid can also enter the hopper throat 74, through a throat inlet 90 positioned between the hopper throat valve 56*b* and the mixing chamber 76. A small amount of the fluid, of approximately 12 to 15 gallons per minute is routed from the inlet 32 area to the throat inlet 90, through throat inlet line 92. In this example embodiment, the throat inlet 90 is positioned such that the fluid enters the hopper throat 74 tangentially to its inside circumference, as shown in FIG. 4. The throat inlet line 92 has a throat inlet line valve 94, and a "T" connection 96 whereby a fluid inspection line 98 can receive a portion of the fluid for discharge through fluid inspection line valve 100. The throat inlet 90 has an internal diameter of approximately three-fourths inch, as well as the throat inlet line 92, the "T" connection, the fluid inspection line 98, the throat inlet line valve 94 and the fluid inspection line valve 100, such valve 94,100 being rated at 150 psi. In this example embodiment, the fluid is routed through the throat inlet line 92 from the same source of the fluid, although other sources are present in alternate embodiments (not shown), in accordance with our invention, as will occur to persons of skill in the art upon review of the present disclosure.

The respective positioning of the throat inlet 90 and the vacuum inlet 82 allows the fluid to enter the hopper throat 74 above the vacuum inlet 82. When the hopper throat valve 56*b* is closed and the fluid is being jetted, an undesirable vacuum can form in the hopper throat 74 in the area above the vacuum inlet 82, while the vacuum inlet 82 is discharging materials to be drawn into the fluid. This can cause undesirable accumulations of materials in the hopper throat 74 when partially wetted materials are drawn into the area above the vacuum inlet 82. Pressured fluid entry through the throat inlet 90 substantially eliminates this vacuum.

With further regard to the foregoing example embodiment, service and inspection access is provided to the replaceable jet 78, by a detachable side inspection plate 102, which is attached by bolts 104. In an alternate embodiment (not shown), the vacuum inlet 82 can be positioned on the side inspection plate 102.

A conventional venturi hopper (not shown), having no vacuum inlet, no throat inlet, and no side inspection plate, is present in other embodiments, as well as other material addition devices, in accordance with our invention, as will occur to those of skill in the art upon review of the present disclosure.

Figure 5C:
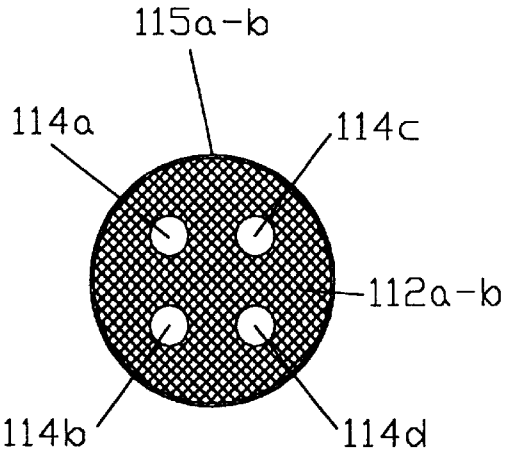
FIGS. 5*a–d* depict a high shear jet insert installation in an embodiment.
Figure 5B:
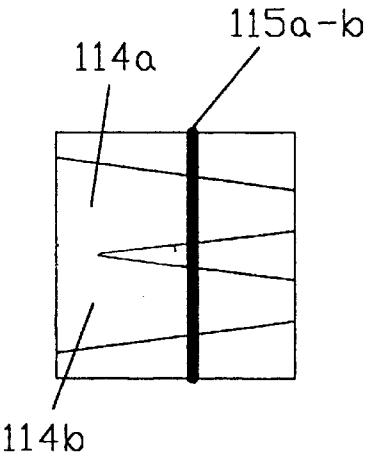
Figure 5A:
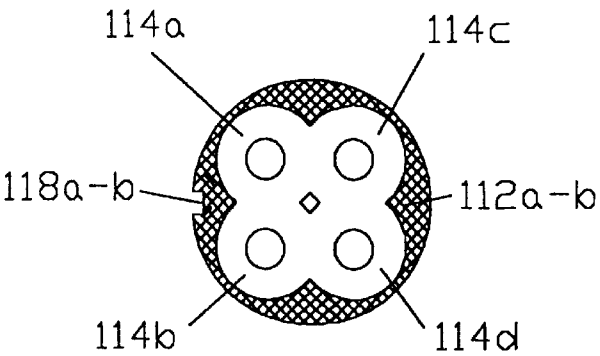
Figure 5D:
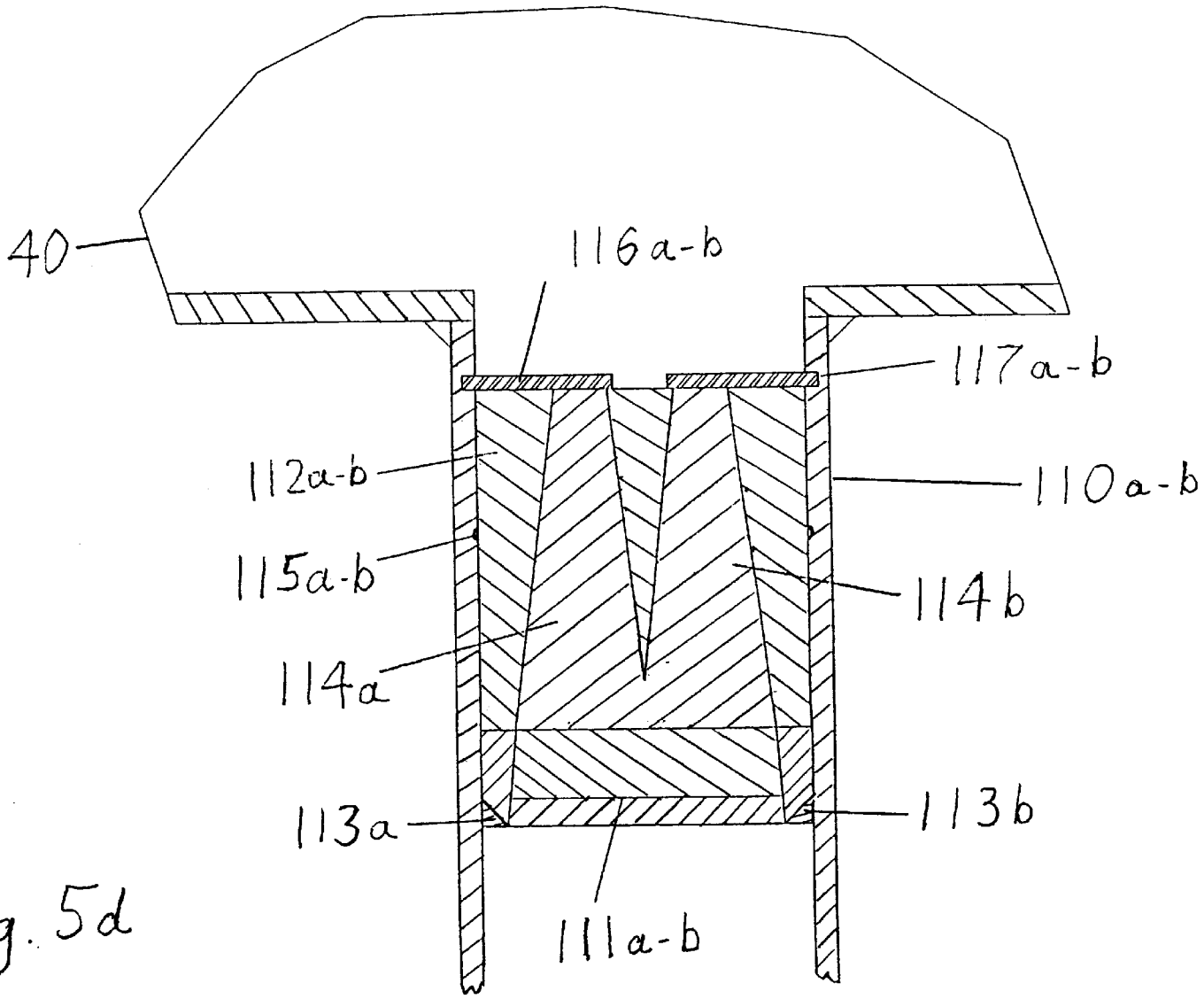
Figure 6B:
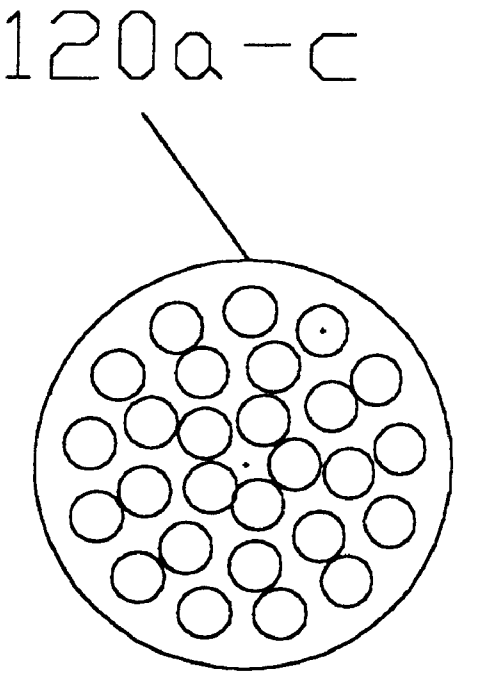
FIGS. 6*a–b* depict a shear plate in an embodiment.
Figure 6A:
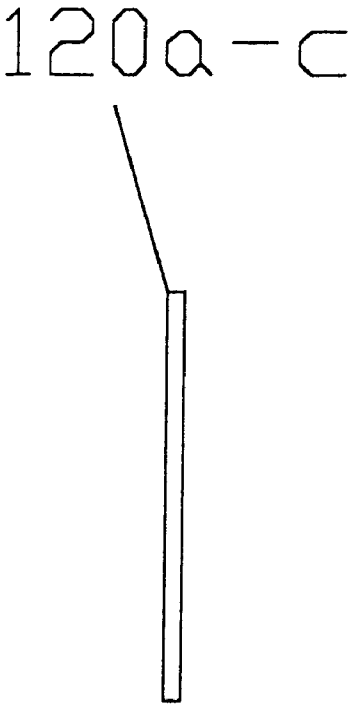
Figure 7B:
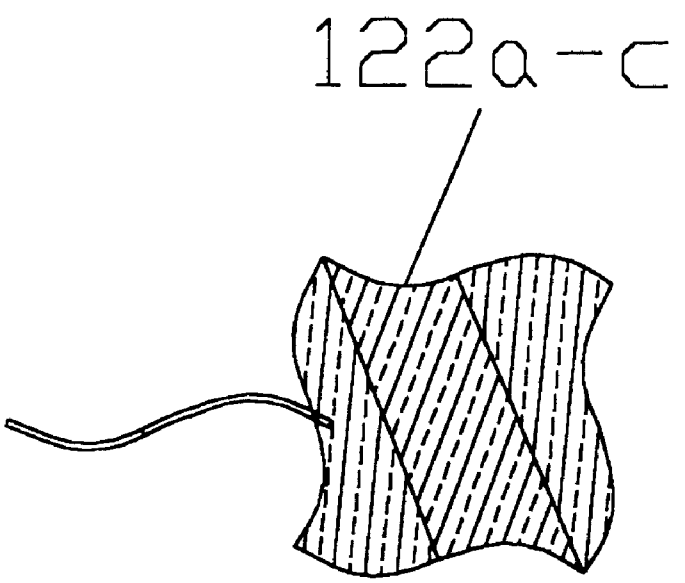
FIGS. 7*a–b* depict a static mixer in an embodiment.
Figure 7A:
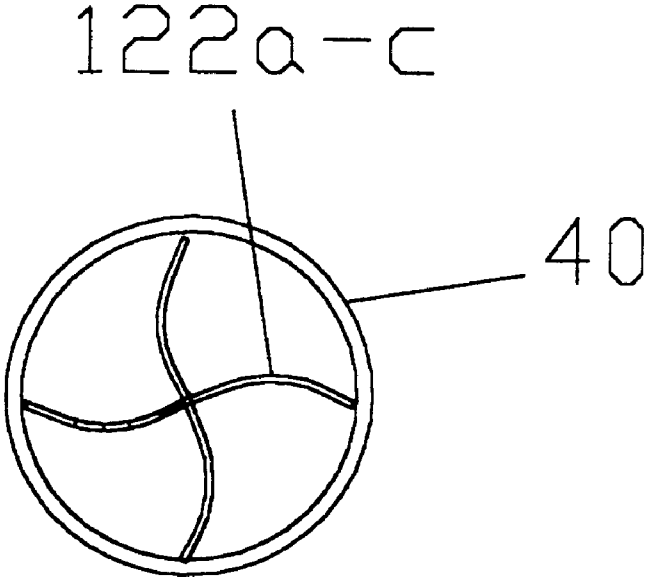

The combination shearing device 38,40 in this example embodiment comprises a first shearing device 38, which further comprises pipe sections 110*a–b*. Jet inserts 112*a–b* are also provided, and are shown more fully in FIGS. 1,5*a–d*. Each jet insert 112*a–b* is placed near the discharge end of each pipe section 110*a–b*, each jet insert 112*a–b* being approximately three and one-sixteenth inches in diameter, and each having four tapered bores 114*a–d* leading to the point of discharge. The bores are each tapered from approximately one and one-half inch diameters to one-half inch diameters. The jet inserts 112*a–b* are made of 4140 steel, but other materials, such as high density polyurethane, made be substituted, in accordance with our invention, as will occur to those of skill in the art upon review of the present disclosure. Within each pipe section 110*a–b*, is attached a jet insert seat ring 111*a–b*, as shown in FIG. 5*d*. This ring 111*a–b* is approximately three-fourths of an inch in depth and has a straight then tapered internal diameter from approximately 2.75 inches to 2.674 inches. The ring 111*a–b* is secured by welds 113*a–b*, and is configured such that each jet insert 112*a–b* abuts the ring 111*a–b* when inserted in the pipe sections 110*a–b*. Each jet insert 112*a–b* is sealably positioned within the pipe sections 110*a–b* by an O-ring 115*a–b*. Each jet insert is further secured within the pipe sections 110*a–b* by a snap ring 116*a–b* which corresponds with grooves 117*a–b* in the pipe sections 110*a–b*, as well as a jet insert key slot 118*a–b* which corresponds with a key (not shown) positioned within the pipe sections 110*a–b*, as shown in FIGS. 5*a–d*. The key and key slot 118*a–b* configuration allows the four jet insert bores 114*a–d* of each jet insert 12*a–b* to be positioned in direct opposition to the jet insert bores 114*a–d* of the opposing jet insert 112*a–b*, such that each bore 114 on one jet insert 112*a* is in alignment with a bore 114 on the second jet insert 112*b*. The pipe sections 110*a–b* are thus configured to direct the fluid jetted from the jet inserts 112*a–d*, such that, upon discharge from the pipe sections 110*a–b*, the two jetted fluid flows will interact, causing fluid turbulence. In this example embodiment, the two jetted fluid flows are substantially in line for direct opposition, although other angles of interaction are present in alternate embodiments (not shown), including anticipated angled interactions, in accordance with our invention, as will occur to those of skill in the art upon review of the present disclosure. The jet inserts 112*a–b* may be dislodged from the pipe sections 110*a–b* by opening the removal tool ports 121*a–b*, and inserting a rod (not shown) into the pipe sections 110*a–b* until it reaches the jet insert 112*a–b* position.

In alternate embodiments (not shown), no jetting mechanism is provided, in which case the shearing function is provided only by the interaction of opposing fluid flows from pipe sections 110*a–b*. Furthermore, different combinations of jet inserts 112*a–b*, with differing numbers of bores 114, as well as different types of jetting mechanisms and other high velocity shearing mechanisms, are contemplated in alternate embodiments (not shown), in accordance with our invention, as will occur to those of skill in the art upon review of the present disclosure.

The combination shearing device 38,40 in this example embodiment further comprises a second shearing device 40, which further comprises three low shear plates 120*a–c* and three static mixer sections 122*a–c*, the shear plates 120*a–c* and static mixer sections 122*a–c* being positioned within a pipe section 50*j*. The shear plates 120*a–c* and static mixer sections 122*a–c* are shown in more detail in FIGS. 6*a–b*, 7*a–b*. The shear plates 120*a–c* are approximately six inches in diameter and one-fourth inch thick, with each having approximately 27 three-fourth inch diameter holes. The holes are randomized, although other arrangements and numbers of holes are anticipated, as will occur to those of skill in the art upon review of this disclosure. Each static mixer section 122*a–c* is formed from the angled joinder of two twisted squares of one-eighth inch sheet metal, each square having sides of approximately six inches. Other static mixers, of various materials and shapes are also anticipated, as will occur to those of skill in the art upon review of this disclosure.

Different combinations of either or both of the static mixer sections 122 and the shear plates 120, as well as other shearing mechanisms, are contemplated in alternate embodiments, in accordance with our invention, as will occur to those of skill in the art upon review of the present disclosure.

Figure 8:
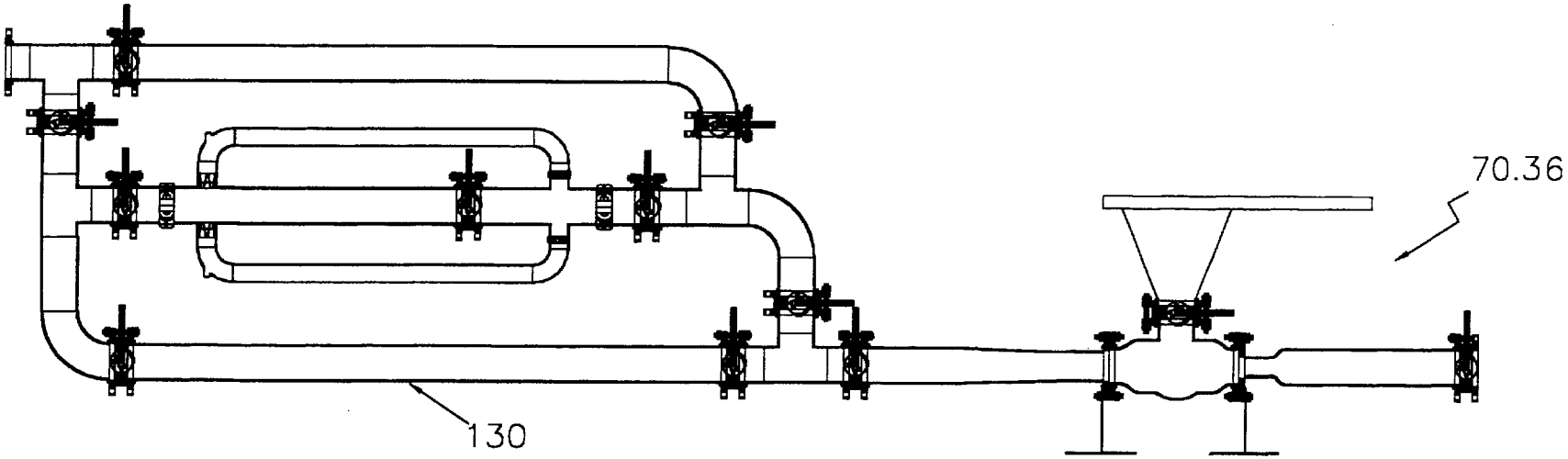
FIG. 8 is a side view of a vertically oriented embodiment, with the material addition device placed to the side of the remaining assembly.

According to still a further embodiment, shown in FIG. 8, a pipe section 130 replaces the entire materials addition device 36, the materials addition device 36, being relocated between the inlet 32 and the first conduit branch 42. Although this interjects the materials addition device 36 into all fluid paths, it enables the remainder of the system to be vertically positioned, without widening the distance between pipe section 130 and the combination shearing device 38,40. In an alternate embodiment (not shown), the combination shearing device 38,40 is rotated approximately ninety degrees, such that it lies in a plane substantially perpendicular to the substantially vertical plane of the pipe sections 50*c–h*, 130. In still a further embodiment (not shown), a bypass is provided which eliminates the material addition device 36 from all fluid paths, if desired. In still a further embodiment (not shown), the materials addition device 36 is eliminated altogether.

Figure 9:
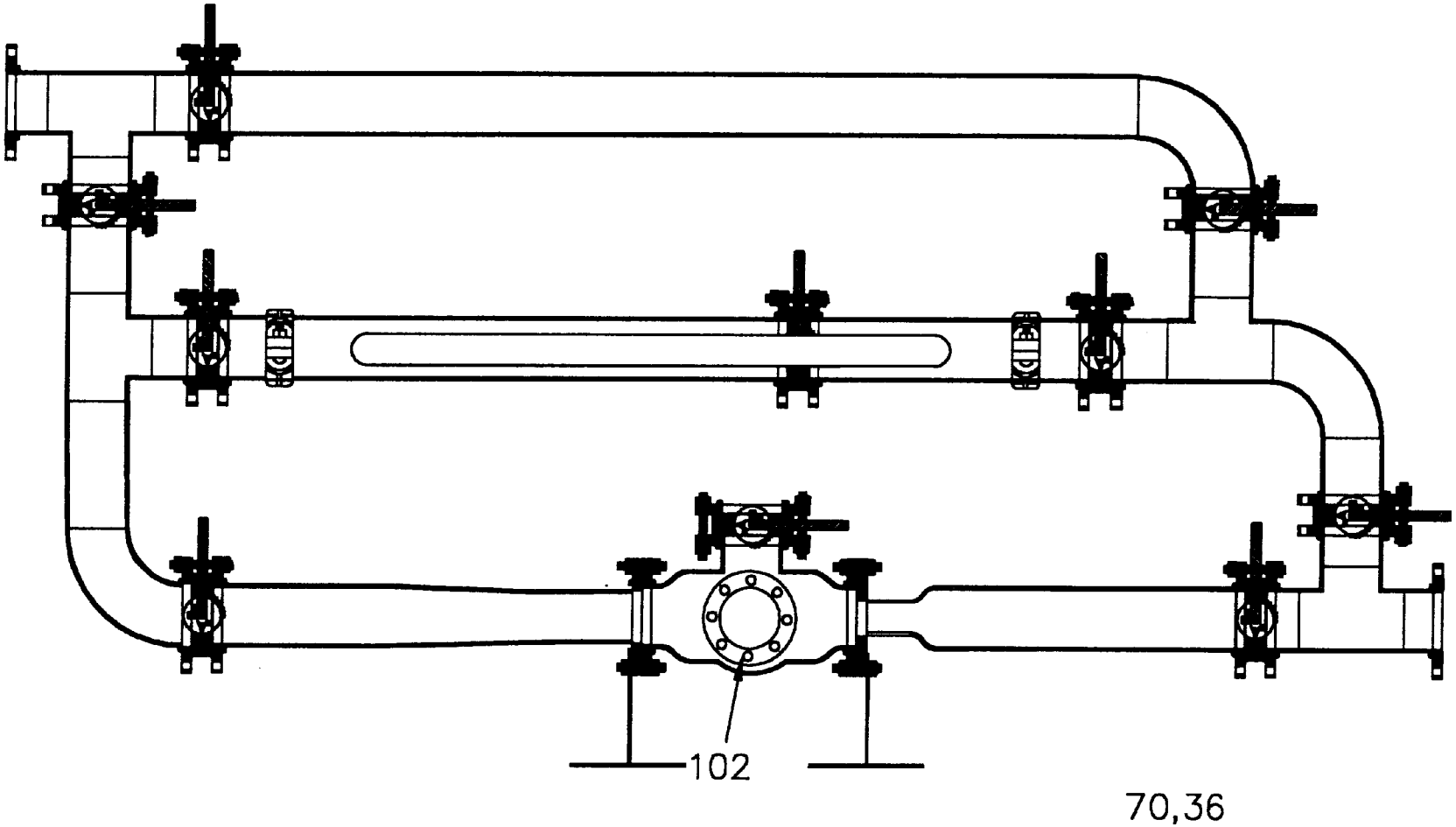
FIG. 9 is a side view of a vertically oriented embodiment in which the material funnel has been removed from the venturi hopper.

According to a further embodiment, shown in FIG. 9, the system is vertically positioned with the material funnel removed from the venturi hopper 70. The removal of the material funnel 72 enables the attachment of a remote bulk materials supply (not shown) to either the hopper throat valve 56*b*, the mixing chamber 76 (by removal of side inspection plate 102), or the hopper throat 74 (by removal of the hopper throat valve 56*b*). Such material funnel 72 removal is an available option in numerous embodiments. The attachment of a bulk material supply to the mixing chamber 76 is also available in all embodiments having a removable side inspection plate 102. In an alternative embodiment (not shown), the materials addition device 36 is rotated as needed to accommodate the attachment of a remote bulk materials supply.

The removal of the material funnel 72, the attachment of a bulk material supply to the hopper throat 74, hopper throat valve 56*b*, or mixing chamber 76, the rotation of the combination shearing device 38,40, and the rotation of the materials addition device 36 are contemplated as options for numerous embodiments discussed herein, as well as other alternate embodiments, in accordance with our invention, as will occur to a person of skill in the art upon a review of this disclosure.

Figure 2:
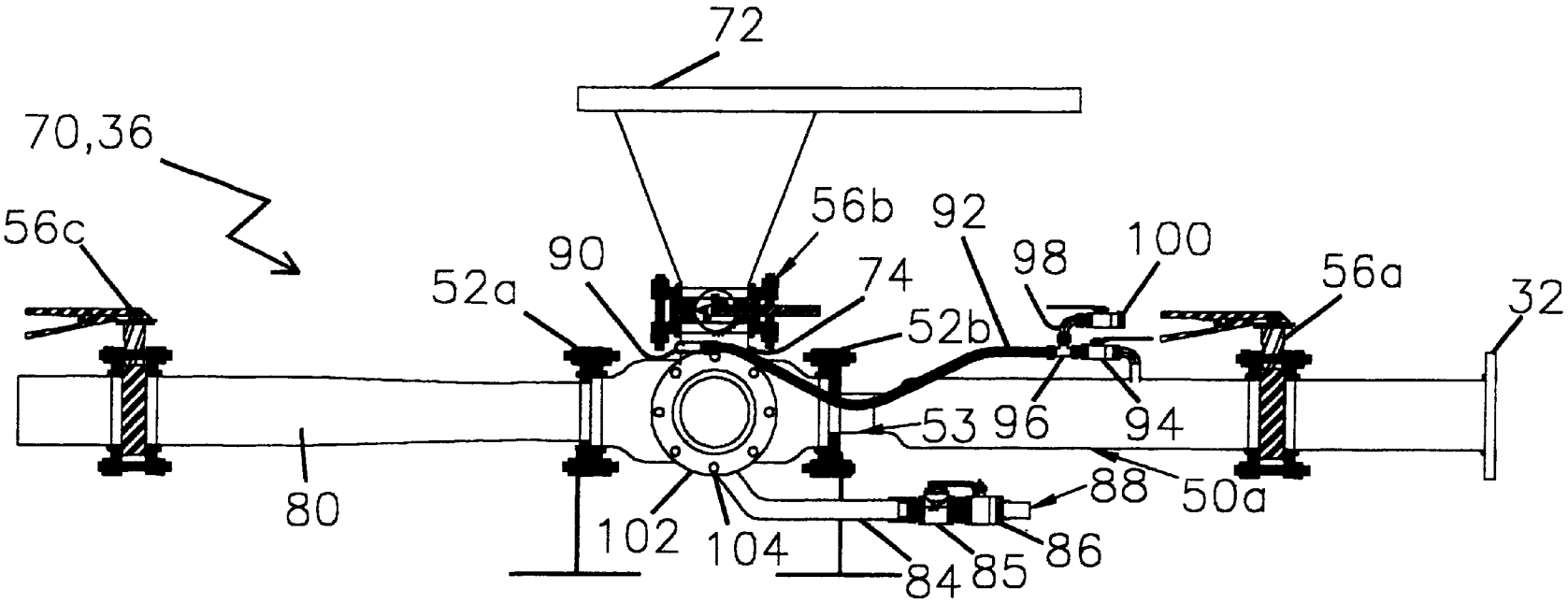
FIG. 2 is a side view of the material addition device in an embodiment.
Figure 3:
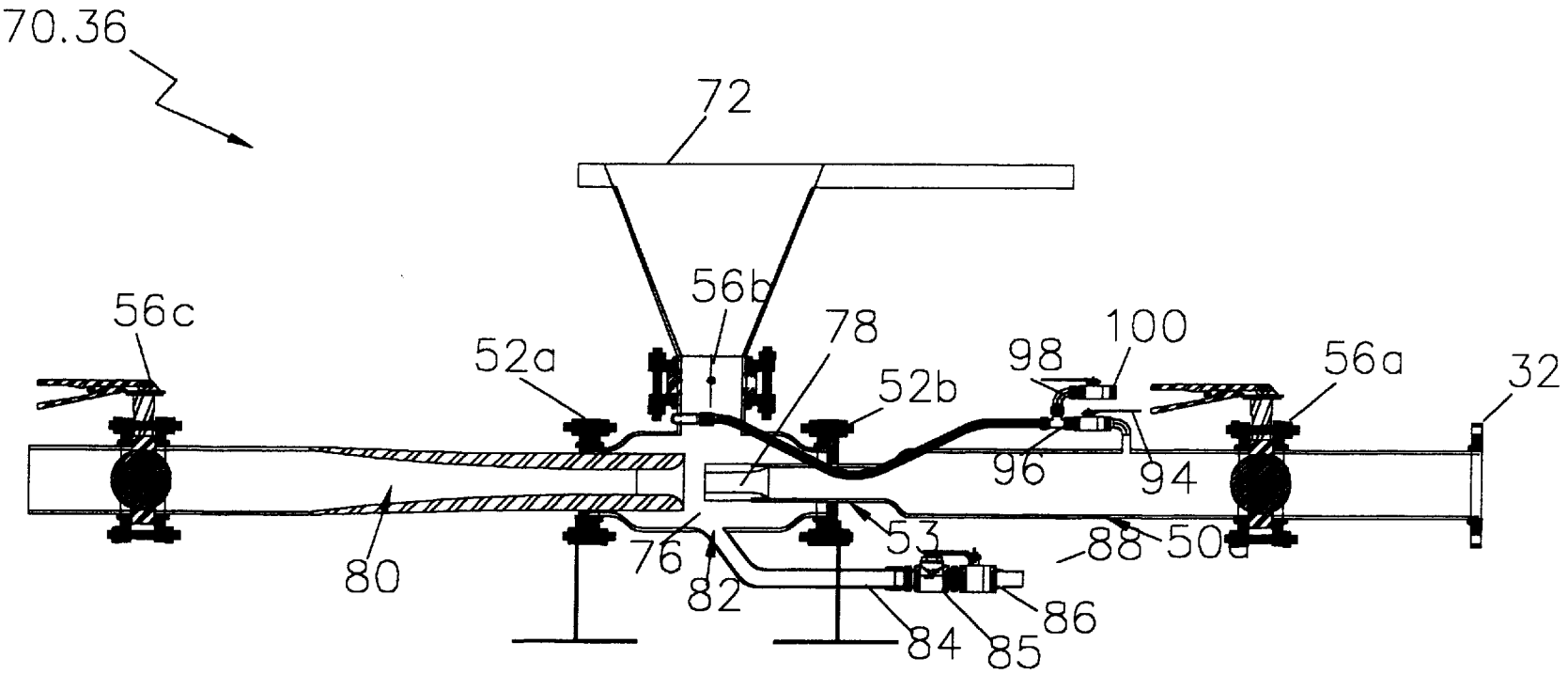
FIG. 3 is a side view cut away of the material addition device in an embodiment cut along cutting plane 3—3.
Figure 10:
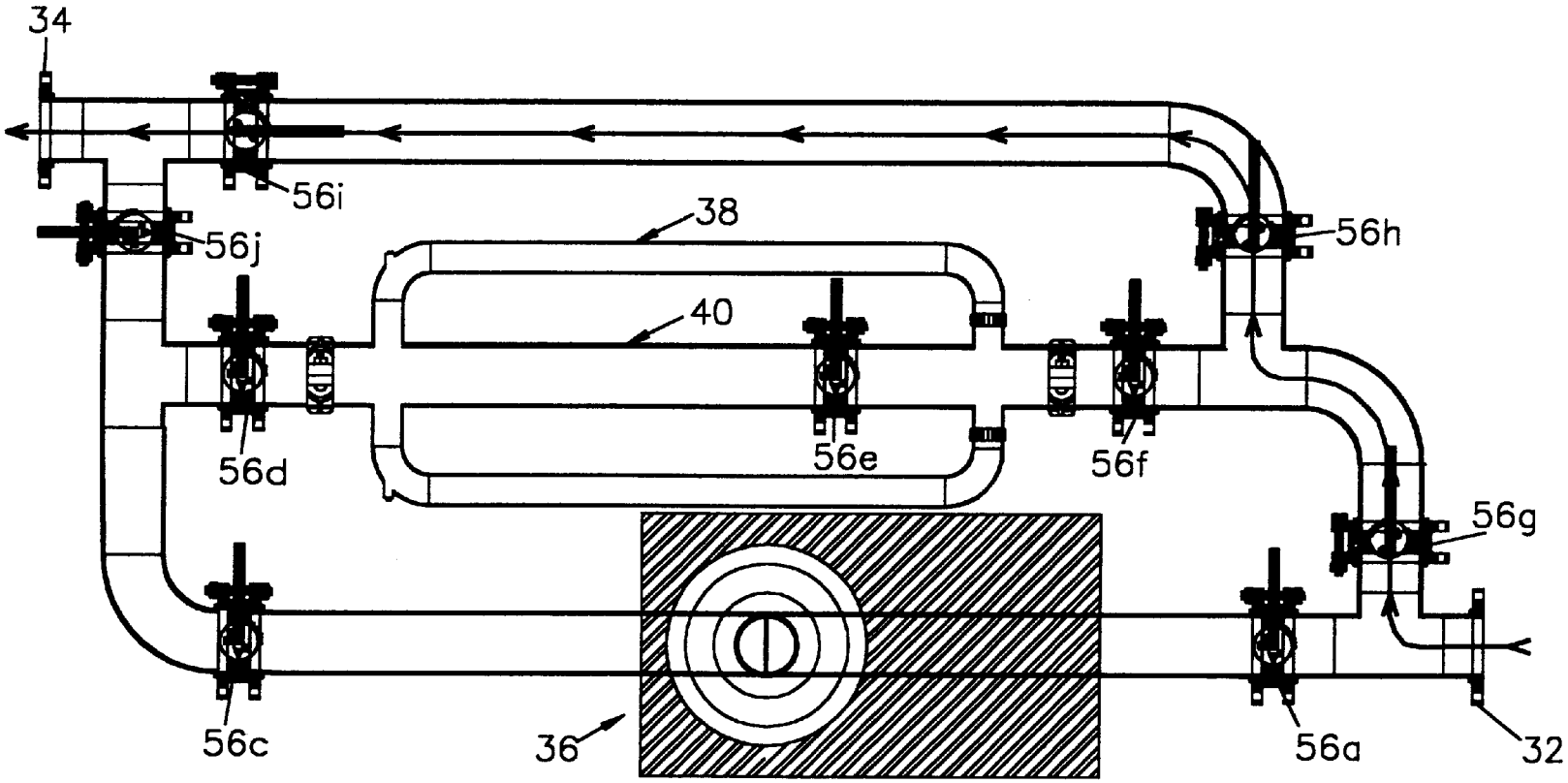
FIG. 10 is a top view of an embodiment depicting an optional fluid routing path.
Figure 11:
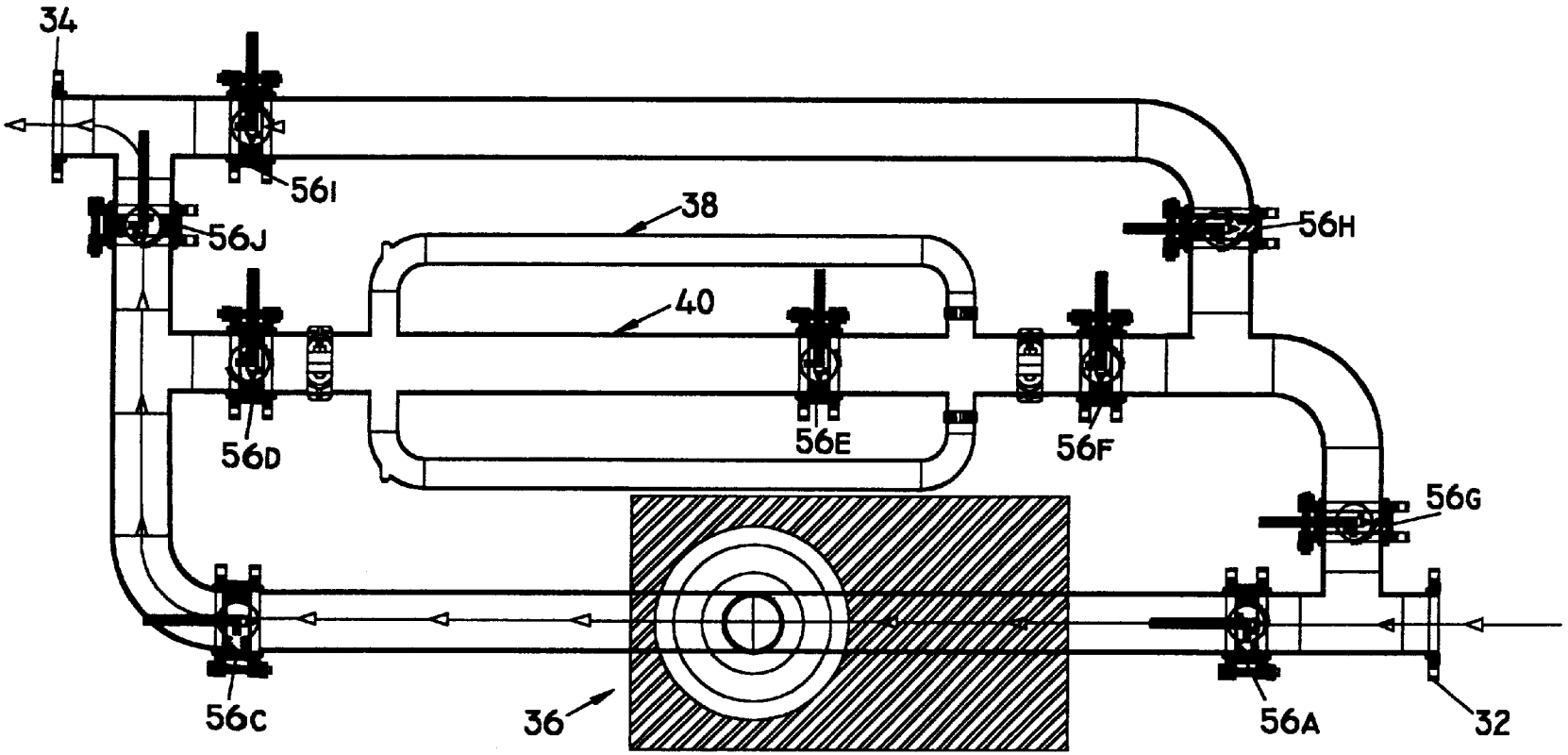
FIG. 11 is a top view of an embodiment depicting an optional fluid routing path.
Figure 12:
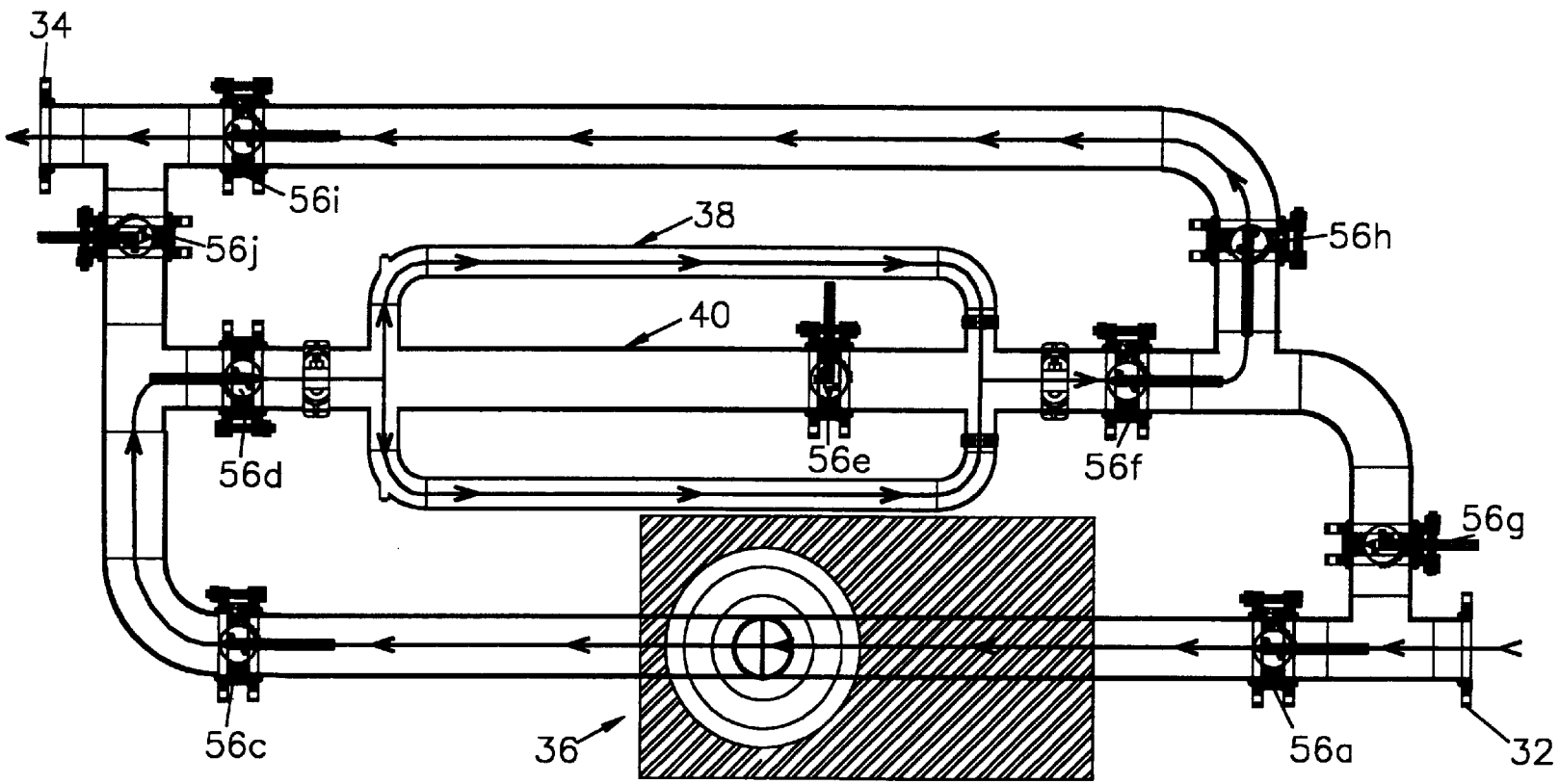
FIG. 12 is a top view of an embodiment depicting an optional fluid routing path.
Figure 13:
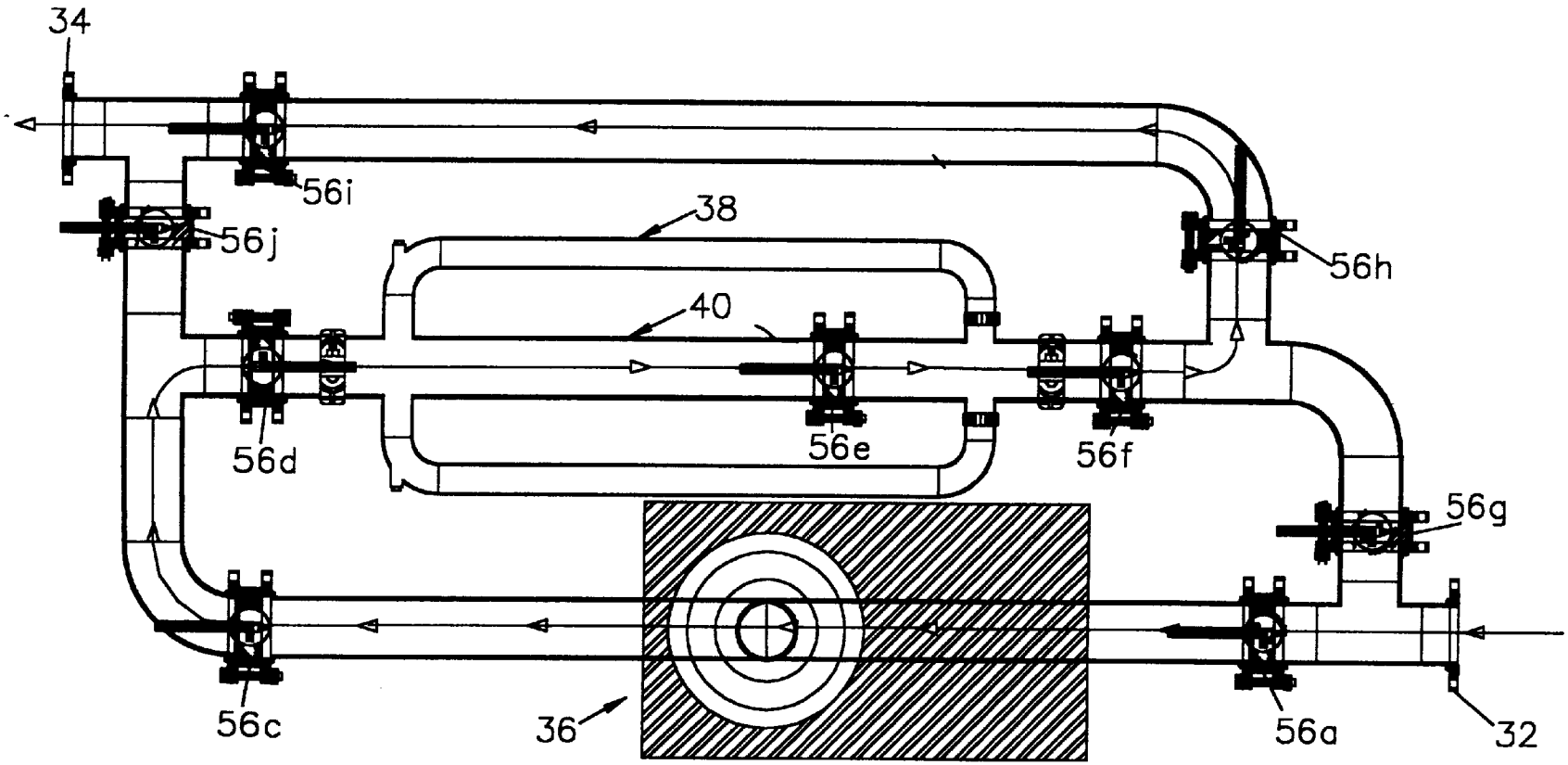
FIG. 13 is a top view of an embodiment depicting an optional fluid routing path.
Figure 14:
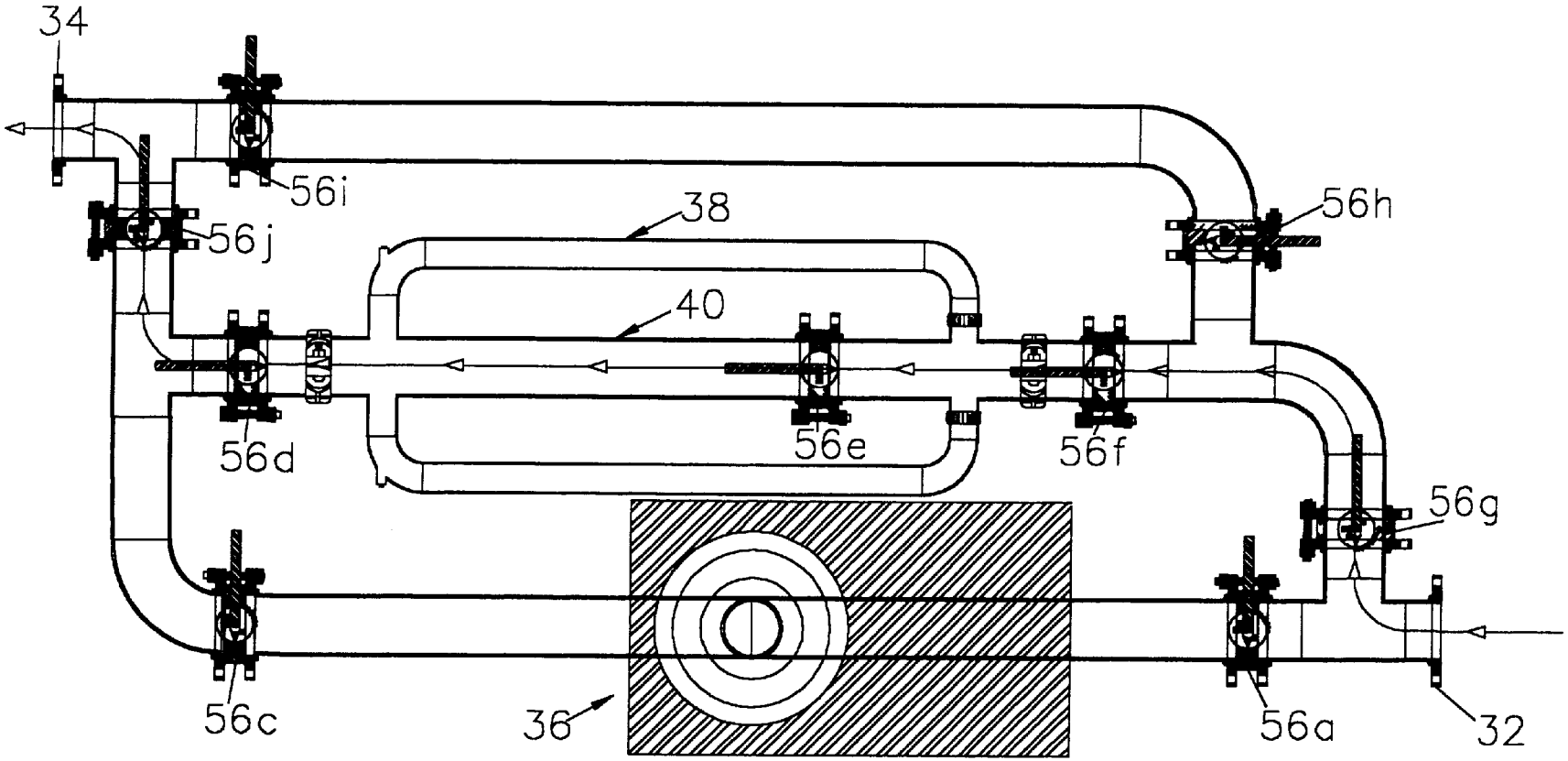
FIG. 14 is a top view of an embodiment depicting an optional fluid routing path.
Figure 15:
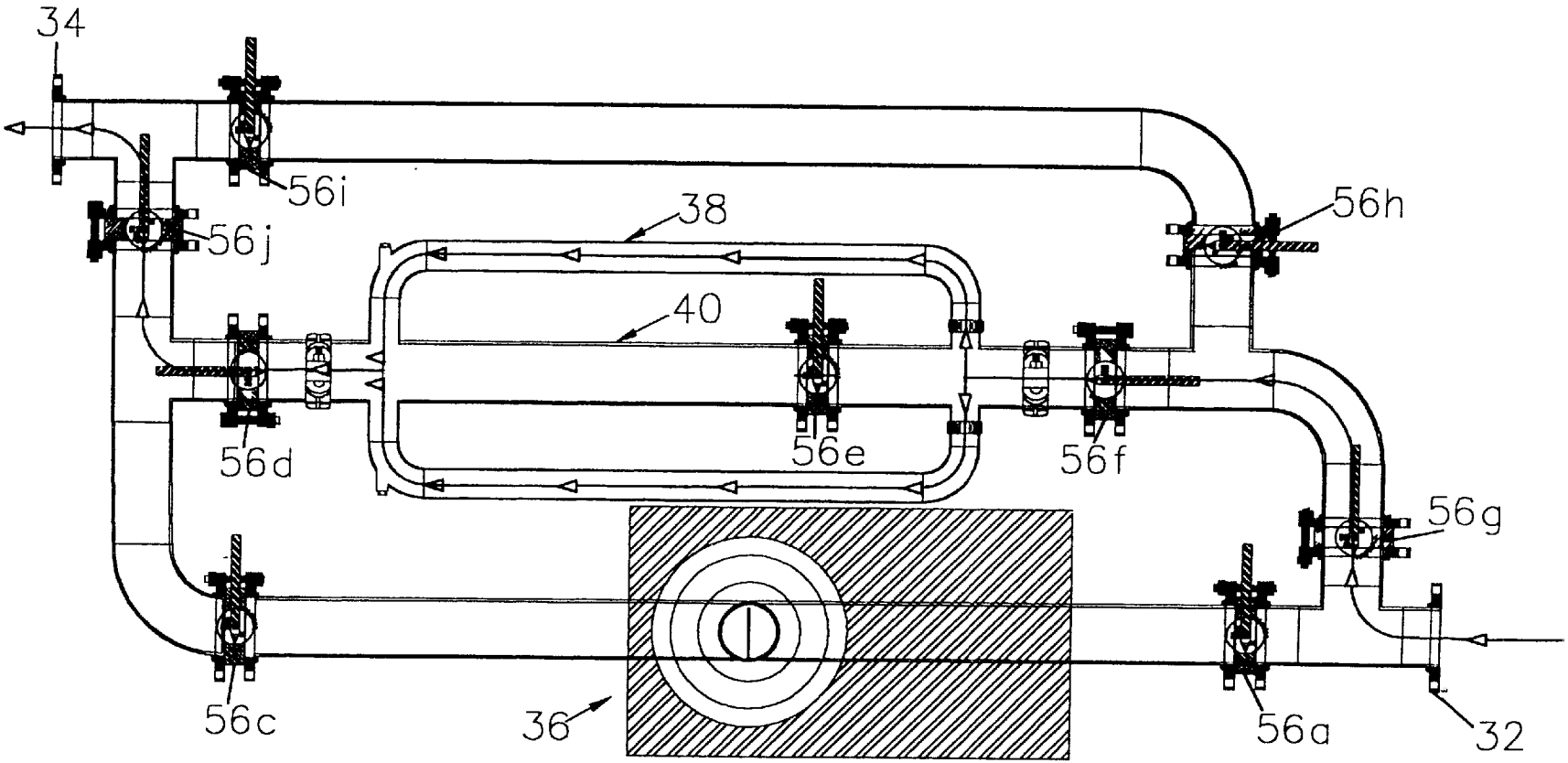
FIG. 15 is a top view of an embodiment depicting an optional fluid routing path.

FIGS. 10–15 depict schematic representations of several fluid paths, which are available in the example embodiment of FIGS. 1–3. As shown in FIG. 10, the fluid can be routed directly from the inlet 32 through the outlet 34, by opening valves 56*g,h,i* and closing valves 56*a,f,j*. FIG. 11, shows that the fluid can be routed from the inlet 32, through the materials addition device 36, and then through the outlet 34, by opening valves 56*a,cj* and closing valves 56*d,g,i*. In FIG. 12, the fluid is being routed from the inlet 32, through the materials addition device 36, through the first velocity shearing device 38 in a first direction, then through the outlet 34. For this flow path, valves 56*a,c–d,f,h–i* are open, and valves 56*e,g,j*. Similarly, FIG. 13 depicts the fluid being routed from the inlet 32, through the materials addition device 36, through the shearing device 40 in a first direction, then through the outlet 34. In this situation, valves 56*a,c–f, h–i* are open, while valves 56*g,j* are closed. A fluid path that bypasses the materials addition device 36, but goes through the second shearing device 40 in a second direction, then through the outlet 34, is shown in FIG. 14, wherein the valves 56*d–g,j* are open, with valves 56*a,h* being closed. FIG. 15 depicts the fluid being routed from the inlet 32, through the first shearing device 38 in a second direction, then through the outlet 34. For this flow path, valves 56*d–g,j* are open, while valves 56*a,c,h–i* are closed. The hopper throat valve 56*b* can be opened or shut depending on the desired usage of the materials addition device 36.

In an alternate embodiment (not shown), the combination shearing device 38,40 is replaced such that only one shearing device path is provided, the type of shearing device mechanism remaining in the single path being of such type as will occur to those of skill in the art upon review of the present disclosure.

Figure 16:
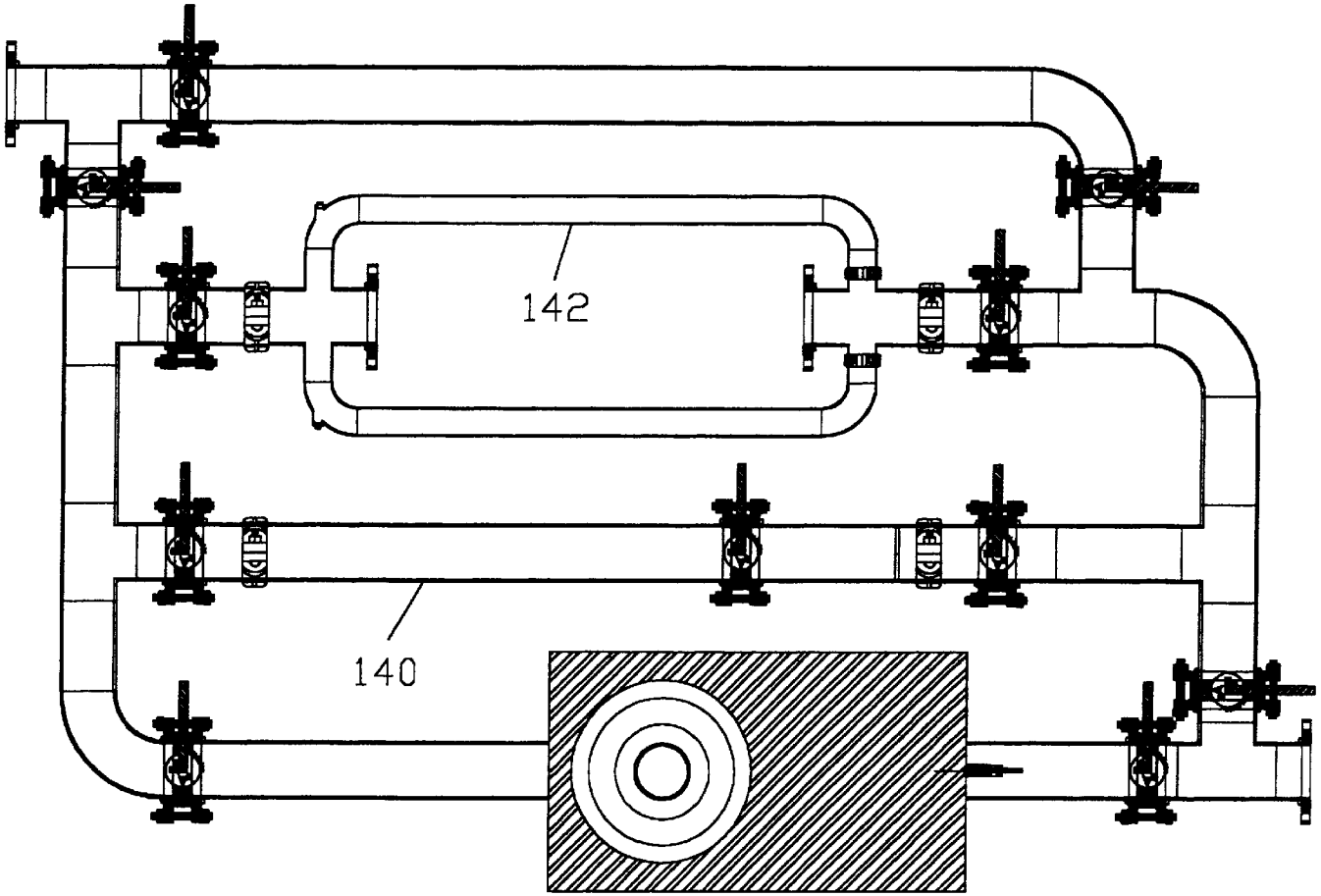
FIG. 16 is a top view of an embodiment.

According to yet a further embodiment, the shearing device combination is replaced by a second shearing device 140 and a first shearing device 142 connected in parallel, as shown in FIG. 16.

According to a further embodiment (not shown), an additional six inch flange connection is positioned between flange 52*b* and the point at which throat inlet line valve 94 draws fluid from pipe section 50*a*.

Furthermore, the features of many of the embodiments discussed above are interchangeable with other embodiments, and it is contemplated that additional embodiments will be practiced using various combinations of such features.

Although the present invention has been described in considerable detail with reference to certain embodiments thereof, other embodiments are possible. The illustrated or described embodiments are given by way of example only and other embodiments will occur to those of skill in the art without departing from the spirit of the invention. Accordingly, the spirit and scope of the claims should not be limited to the description of the embodiments contained herein.

We claim:

1. An apparatus for handling and preparing a fluid, comprising:

a materials addition device, for receiving and adding one or more materials to the fluid;

a shearing device for shearing fluid, the shearing device having a first and second end;

a first pipe and valve combination comprising:

an inlet for receiving the fluid into the apparatus;

an outlet for discharging the fluid from the apparatus;

inlet piping, having an inlet piping valve, the inlet piping connecting the inlet with the materials addition device;

outlet piping, having a first outlet piping valve, the outlet piping connecting the materials addition device with the outlet;

a second pipe and valve combination comprising:

shearing device first end piping, having a shearing device first end piping valve, the shearing device first end piping connecting the shearing device first end with the outlet piping;

shearing device second end piping, having a first and a second shearing device second end piping valve, the shearing device second end piping connecting the shearing device second end with the outlet piping; and a third pipe and valve combination comprising:

reverse flow piping, having a reverse flow piping valve, the reverse flow piping connecting the inlet piping to the shearing device second end piping.

2. The apparatus of claim 1, wherein the materials addition device further comprises a first bulk material port for receiving one or more materials into the materials addition device.

3. The apparatus of claim 2, wherein the materials addition device further comprises a vacuum inlet for receiving one or more materials into the materials addition device.

4. The apparatus of claim 2, wherein the materials addition device further comprises a second bulk material port for receiving one or more bulk materials into the materials addition device.

5. The apparatus of claim 4, wherein the materials addition device further comprises a detachable side portion, the second bulk material port being positioned on the side portion.

6. The apparatus of claim 2, wherein the first bulk material port further comprises a material funnel for receiving one or more materials into the materials addition device.

7. The apparatus of claim 1, wherein the materials addition device further comprises a venturi hopper.

8. The apparatus of claim 1, wherein the materials addition device further comprises an eductor assembly.

9. The apparatus of claim 1, wherein the first pipe and valve combination lies in a substantially planar orientation, and the materials addition device is rotatable positionally with respect to such plane, such that the materials addition device can be oriented to lie in the plane or at an angle thereto.

10. The apparatus of claim 1, wherein the shearing device and the materials addition device are positioned in a substantially vertical plane.

11. The apparatus of claim 1, wherein the materials addition device further comprises a detachable side portion.

12. The apparatus of claim 1, wherein the fluid shearing device further comprises a plurality of conduits, each such conduit having a first end and a second end, the conduit first ends being positioned such that, as the fluid flows through the fluid shearing device, the fluid is diverted into the first ends of the plurality of conduits, and is discharged from the conduit second ends, the conduit second ends being positioned to discharge the fluid in opposing flows as the conduits are rejoined, such that all or some of the fluid in the opposing flows interacts.

13. The apparatus of claim 12, further comprising a jet, the jet being positioned within at least one of the plurality of conduits such that the fluid in such at least one conduit is jetted as it is discharged from the second end of such at least one conduit.

14. The apparatus of claim 1, wherein the first pipe and valve combination outlet piping further comprises a second outlet piping valve, the second outlet piping valve being positioned between the first outlet piping valve and the materials addition device.

15. The apparatus of claim 1, wherein the second pipe and valve combination shearing device second end piping further comprises a shearing device second end piping third valve positioned between the shearing device second end piping second valve and the outlet.

16. The apparatus of claim 1, wherein the shearing device comprises at least one shear plate, the at least one shear plate being positioned within the shearing device such that the fluid passes through the at least one shear plate as the fluid moves through the shearing device.

17. The apparatus of claim 1, wherein the shearing device comprises at least one static mixer, the at least one static mixer being positioned within the shearing device such that the fluid passes through the at least one static mixer as the fluid moves through the shearing device.

18. The apparatus of claim 1, wherein the shearing device comprises at least one shear plate and at least one static mixer, the at least one shear plate and the at least one static mixer being positioned within the shearing device such that the fluid passes through the at least one shear plate and the at least one static mixer as the fluid moves through the shearing device.

* * * * *

UNITED STATES PATENT AND TRADEMARK OFFICE

CERTIFICATE OF CORRECTION

PATENT NO. : 6,305,835 B1
DATED : October 23, 2001
INVENTOR(S) : Joseph D. Farrar and Jimmy P. Lavoie It is certified that error appears in the above-identified patent and that said Letters Patent is hereby corrected as shown below:

Title page,
Below Item [76], insert the following:

-- [73] Assignee: Oiltools International B. V.,
Amsterdam, Netherlands --.

Signed and Sealed this

Twenty-eighth Day of May, 2002

*Attest:*

*Attesting Officer*

JAMES E. ROGAN
*Director of the United States Patent and Trademark Office*